US010223859B2

(12) United States Patent
Massing et al.

(10) Patent No.: US 10,223,859 B2
(45) Date of Patent: Mar. 5, 2019

(54) AUGMENTED REALITY GAMING EYEWEAR

(71) Applicant: Bally Gaming, Inc., Las Vegas, NV (US)

(72) Inventors: Scott A. Massing, Lincolnwood, IL (US); Damon E. Gura, Chicago, IL (US); Daniel P. Louie, Chicago, IL (US); Jesse M. Smith, Chicago, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 505 days.

(21) Appl. No.: 13/788,249

(22) Filed: Mar. 7, 2013

(65) Prior Publication Data

US 2014/0121015 A1 May 1, 2014

Related U.S. Application Data

(60) Provisional application No. 61/720,244, filed on Oct. 30, 2012.

(51) Int. Cl.
*G07F 17/32* (2006.01)

(52) U.S. Cl.
CPC ..... *G07F 17/3211* (2013.01)

(58) Field of Classification Search
CPC ..... A63F 2300/00; A63F 2300/30; A63F 2300/60; G07F 17/32; G07F 17/3202;
(Continued)

(56) References Cited

U.S. PATENT DOCUMENTS 6,582,310 B1 6/2003 Walker et al.
6,771,294 B1 * 8/2004 Pulli ..... G06F 3/011 345/173

(Continued)

FOREIGN PATENT DOCUMENTS

EP 1089223 9/2003
JP 2008194202 8/2008

(Continued)

OTHER PUBLICATIONS

"Demos Produced by Popcode", Popcode http://www.popcode.info/demos Date Obtained from the Internet: Feb. 12, 2013 2010 , 4 pages.

(Continued)

*Primary Examiner* — Tramar Harper
*Assistant Examiner* — Jeffrey Wong
(74) *Attorney, Agent, or Firm* — Martin A. Hein

(57) ABSTRACT

A wagering game system and its operations are described herein. In some embodiments, the operations can include detecting initiation of a wagering game and determining, in response to the detecting the initiation of the wagering game, first content and second content to present for the wagering game. The operations can further include providing the first content for presentation on a display device, the first content being viewable through the gaming eyewear, and providing the second content for presentation as a virtual image via the gaming eyewear.

24 Claims, 13 Drawing Sheets

(58) Field of Classification Search
CPC ..... G07F 17/3206; G07F 17/3209; G07F 17/3211; G07F 17/3213; G07F 17/3216; G07F 17/326
USPC ..... 463/30
See application file for complete search history.

(56) References Cited

U.S. PATENT DOCUMENTS

| | | | | |
|---|---|---|---|---|
| 7,241,219 | B2 | 7/2007 | Walker et al. | |
| 7,871,327 | B2 | 1/2011 | Walker et al. | |
| 7,892,097 | B2 | 2/2011 | Muir et al. | |
| 7,909,696 | B2 | 3/2011 | Beaulieu et al. | |
| 8,002,619 | B2 | 8/2011 | Gagner et al. | |
| 8,057,303 | B2 | 11/2011 | Rasmussen et al. | |
| 8,376,842 | B2 | 2/2013 | Rasmussen et al. | |
| 8,403,759 | B2 | 3/2013 | Muir et al. | |
| 8,545,326 | B2 | 10/2013 | Underdahl et al. | |
| 2001/0007830 | A1 | 7/2001 | Suzuki | |
| 2004/0106446 | A1* | 6/2004 | Cannon | G07F 17/32 463/16 |
| 2004/0224755 | A1* | 11/2004 | Tallal, Jr. | G07F 17/32 463/25 |
| 2004/0266525 | A1 | 12/2004 | Adachi | |
| 2005/0075167 | A1 | 4/2005 | Beaulieu et al. | |
| 2005/0107164 | A1 | 5/2005 | Muir et al. | |
| 2006/0128460 | A1 | 6/2006 | Muir et al. | |
| 2008/0020827 | A1 | 1/2008 | Underdahl et al. | |
| 2008/0020848 | A1 | 1/2008 | Muir et al. | |
| 2008/0227538 | A1 | 9/2008 | Kelly et al. | |
| 2009/0005170 | A9 | 1/2009 | Kelly et al. | |
| 2010/0234099 | A1* | 9/2010 | Rasmussen | G07F 17/3218 463/29 |
| 2011/0065496 | A1 | 3/2011 | Gagner et al. | |
| 2011/0098118 | A1 | 4/2011 | Muir et al. | |
| 2012/0184352 | A1 | 7/2012 | Detlefsen et al. | |
| 2013/0050069 | A1* | 2/2013 | Ota | G06F 3/011 345/156 |
| 2013/0059653 | A1* | 3/2013 | Hornik | G07F 17/32 463/26 |
| 2013/0084942 | A1 | 4/2013 | Kelly et al. | |
| 2013/0184064 | A1* | 7/2013 | Manning | G07F 17/3211 463/25 |
| 2013/0278631 | A1* | 10/2013 | Border | G02B 27/017 345/633 |
| 2013/0281208 | A1* | 10/2013 | Lyons | G07F 17/3211 463/33 |
| 2014/0009378 | A1* | 1/2014 | Chew | G06F 3/017 345/156 |

FOREIGN PATENT DOCUMENTS

| | | |
|---|---|---|
| WO | WO-2009123972 | 10/2009 |
| WO | WO-2010048231 | 4/2010 |
| WO | WO-2012065146 | 5/2012 |

OTHER PUBLICATIONS

"EyePet", Wikipedia http://en.wikipedia.org/wiki/EyePet Date Obained from the Internet: Feb. 12, 2013 Last Date Modified: Dec. 29, 2011, 2 pages.

"Invizimals", Wikipedia http://en.wikipedia.org/wiki/Invizimals Downloaded from Internet: Jan. 25, 2013 Last Date Modified Feb. 21, 2012 , 3 pages.

"Layer", Google https://play.google.com/store/apps/details?id=com.layar&hl=en Date Obtained from the Internet: Feb. 12, 2013 Last Date Modified: Sep. 25, 2012 , 2 pages.

"Majestic (video game)", Wikipedia http://en.wikipedia.org/wiki/Majestic_ (video_game) Downloaded from Internet: Jan. 25, 2013 Last Date Modified Jul. 22, 2012 , 2 pages.

"The Eye of Judgment", Wikipedia http://en.wikipedia.org/wiki/The_Eye_of_Judgment Date Obtained from the Internet: Feb. 12, 2013 Last Date Modified: Jul. 27, 2010 , 4 pages.

"Wikitude", Wikipedia http://en.wikipedia.org/wiki/Wikitude Date Obtained from the Internet: Feb. 12, 2013 Last Date Modified: Jan. 10, 2012 , 3 pages.

Acrossair, , "Chicago Nearest Transit", iTunes http://itunes.apple.com/app/chicago-nearest-transit/id331014312?mt=8 Date Obtained from the Internet: Feb. 12, 2013 Last Date Modified: Jul. 19, 2010 , 2 pages.

Baldwin, Roberto , "Google Glass Will Fit Into Your Energy Drink-Fueled Lifestyle", Wired.com http://www.wired.com/gadgetlab/2012/06/google-glass-will-fit-into-your-energy-drink-fueled-lifestyle/ Date Obtained from the Internet: Sep. 25, 2012 Jun. 27, 2012 , 8 pages.

Bedow, Philipp et al., "Augmented Reality Game Application", Ballotpedia http://winfwiki.wi-fom.de/index.php/Augmented_Reality_als_Game_Anwendung Date Obtained from the Internet: Feb. 21, 2013 Last Date Modified: Jan. 14, 2010 , 22 pages.

Hinkle, David , "Hunt Ghosts on your Nintendo DSi with Ghostwire", Joystiq http://www.joystiq.com/2009/05/25/hunt-ghosts-on-your-nintendo-dsi-with-ghostwire/ Date Obtained from the Internet: Feb. 12, 2013 May 25, 2009 , 7 Pages.

Houghton, Stuart , "Tresure Troves—Augmented Reality DS WiFi Game", Kotaku http://kotaku.com/5108003/treasure-troves-+-augmented-reality-ds-wifi-game Date Obtained from the Internet: Feb. 12, 2013 Dec. 11, 2008 , 2 pages.

IGN Staff, "THQ Announces Fantastic Pets, First Augmented Reality Title on Kinect for Xbox 360", IGN http://www.ign.com/articles/2010/10/21/thq-announces-fantastic-pets-first-augmented-reality-title-on-kinect-for-xbox-360 Date Obtained from the Internet: Feb. 13, 2013 Oct. 21, 2010 , 1 page.

Laan Labs, , "ARSoccer—Augmented Reality Soccer Game", iTunes http://itunes.apple.com/us/app/arsoccer-augmented-reality/id381035151?mt=8 Date Obtained from the Internet: Feb. 12, 2013 Last Date Modified: Apr. 22, 2011 , 2 pages.

Magnificent Library, , "Firepower", iTunes http://itunes.apple.com/us/app/firepower/id317465162?mt=8 Date Obtained from the Internet: Feb. 12, 2013 Last Date Modified: Feb. 10, 2010 , 2 pages.

Mills, Matt et al., "Matt Mills: Image Recognition That Triggers Augmented Reality", TEDGlobal 2012 http://www.ted.com/talks/matt_mills_image_recognition_that_triggers_augmented_reality.html Date Obtained from the Internet: Sep. 25, 2012 Jul. 2012 , 12 pages.

Parr, Ben , "Top 6 Augmented Reality Mobile Apps (Videos)", Mashable http://mashable.com/2009/08/19/augmented-reality-apps/ Date Obtained from the Internet: Feb. 12, 2013 Aug. 19, 2009, 4 pages.

* cited by examiner

AUGMENTED REALITY GAMING EYEWEAR

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

TECHNICAL FIELD

Embodiments of the inventive subject matter relate generally to wagering game systems and networks that, more particularly, present content.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Within a gaming environment (e.g., within a casino) wagering game content is typically presented on displays of wagering game machines (e.g., electronic gaming machines (EGMs), wagering game tables, overhead displays, and so forth. For example, wagering game machines can include a primary display on which a primary wagering game is presented as well as one or more secondary, or peripheral, displays on which additional wagering game content is presented, such as bonus games or other secondary content. Wagering game tables, for example, can include multiple displays at various player stations for presentation of gaming content related to a player at the wagering game table. The wagering game table can also include a community display on which gaming content is presented that is related to all players at the wagering game table. Furthermore, some group games utilize large displays for presentation of the group game content. However, the size and locations of displays within a gaming environment are limited. Therefore, the gaming industry can greatly benefit from new gaming enhancements that present content beyond presentation at displays.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operations performed by some embodiments while the third section describes additional example embodiments. The fourth section describes example operating environments while the fifth section presents some general comments.

Introduction

This section provides an introduction to some embodiments.

As stated previously, the gaming industry can greatly benefit from new gaming enhancements, such as new and interesting ways of presenting content. For example, some embodiments of the inventive subject matter present content via gaming eyewear. The gaming eyewear presents wagering game content while objects are viewable via the gaming eyewear. For examples, in some embodiments, the gaming eyewear presents virtual images of gaming content as augmented reality to objects that are viewable via the gaming eyewear. In another example, some embodiments present, via the gaming eyewear, a view of a physical, real-world environment while simultaneously presenting, via the gaming eyewear, a view of computer-generated content ("virtual content"), such as video, graphics, information about the environment and its objects, etc. In some embodiments, the system recognizes characteristics of the objects viewable via the gaming eyewear and generates the virtual content based on the recognition of the characteristics of the objects. Some embodiments present the virtual content via the gaming eyewear in a way that appears related to, or associated with, the objects (e.g., spatially related such as superimposed over a real-world object, connected to a object, or maintained in a position relative to an object). Some embodiments further detect interaction with the virtual content presented via the gaming eyewear and, based on the interaction, perform gaming activities, such as placing wagers and playing wagering games. The combination of virtual content presented with the objects visible via the gaming eyewear can greatly enhance a wagering game player's gaming experience.

Figure 1A:
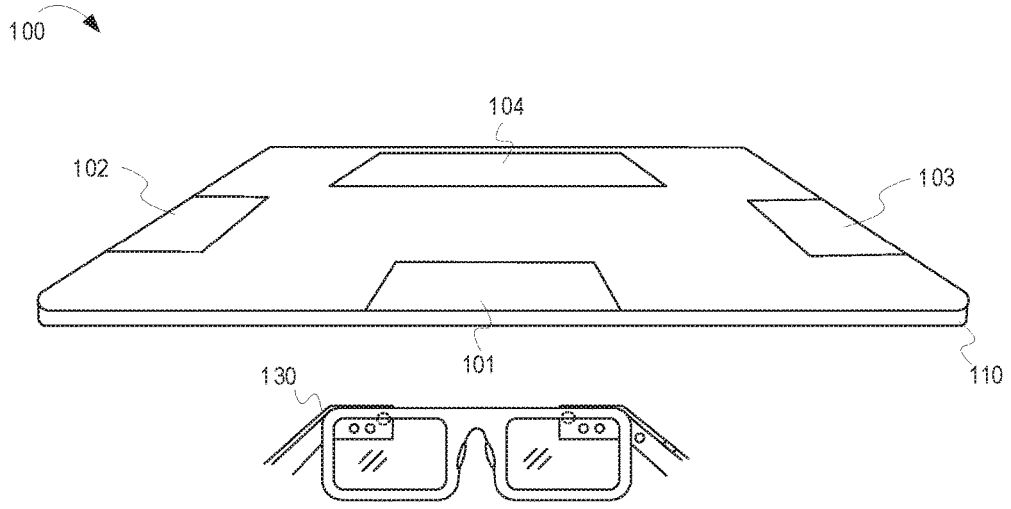
FIGS. 1A-1B are illustrations of presenting augmented reality content via gaming eyewear, according to some embodiments.
Figure 1B:
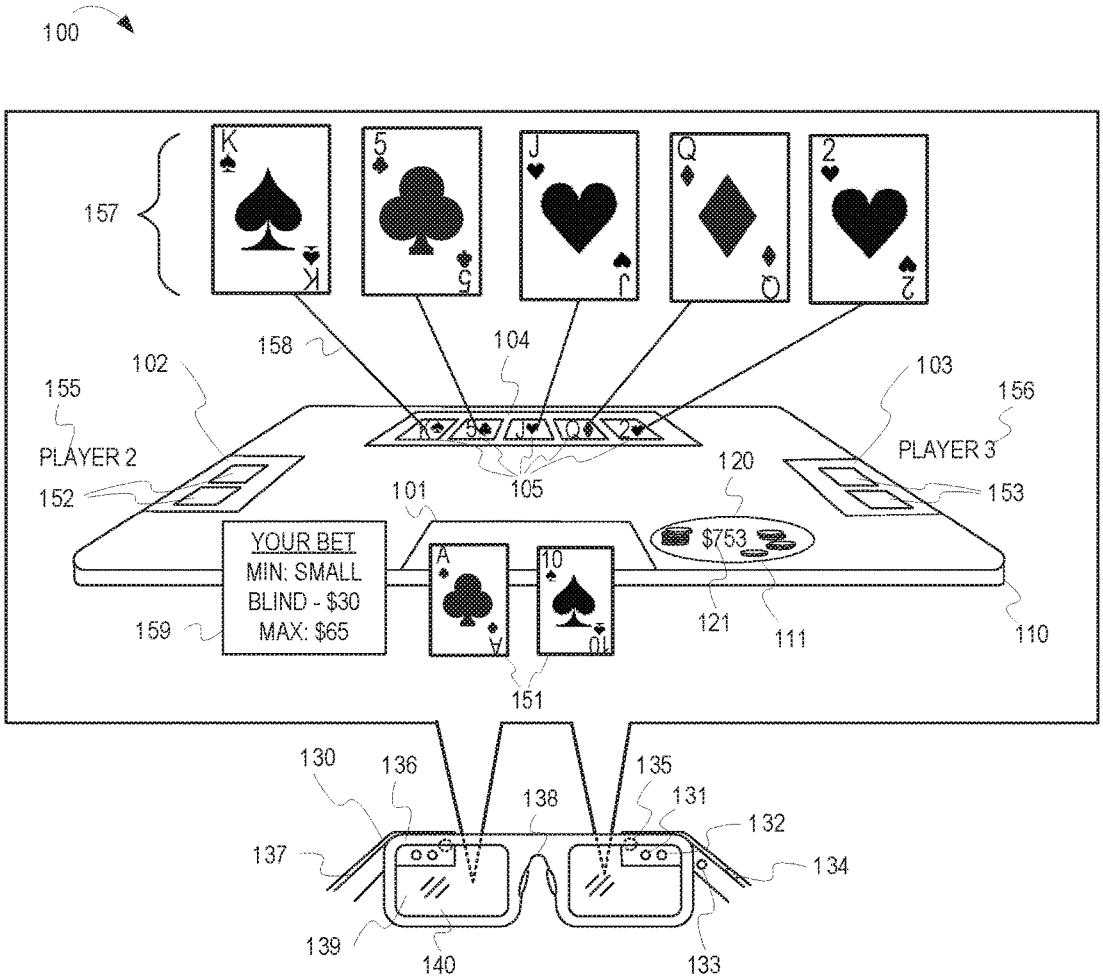

FIGS. 1A-1B are conceptual diagrams that illustrate an example of presenting augmented reality content via gaming eyewear, according to some embodiments. In FIGS. 1A-1B, a wagering game system ("system") 100 is shown. The system 100 includes a gaming table 110. The gaming table 110 has several player-related areas, such as player stations 101, 102, and 103, which are assigned to players that participate in a wagering game, such as a card game (e.g., poker, blackjack, etc.). The player station 101 is associated with a first player, player station 102 is associated with a second player, and player station 103 is associated with a third player. The player stations 101, 102, and 103 can present first content that is individually associated with the first, second, and third players. The gaming table 110 also includes an area 104 from which to present gaming content generally related to the wagering game (e.g., content for a dealer's cards, content for a community hand dealt by a dealer, etc.). For example, FIGS. 1A-1B illustrates a type of wagering game called Texas Hold 'Em Poker. In Texas Hold 'Em Poker, each of the players is dealt individual cards at the beginning of a round of play. The player's individual cards are also referred to as hole cards or pocket cards. Subsequently, a series of community cards are dealt that any of the players can use, in combination with their hole cards, to form the best hand possible. In other words, the player's hold cards have a first set of symbols, the community cards have a second set of symbols, and a combination of the first set of symbols and the second set of symbols form a game outcome. The player's individual cards (e.g., hole cards 151, 152, and 153) are dealt to the player stations 101, 102, and 103 and community cards 105 are dealt to the area 104.

In some embodiments, system 100 also includes gaming eyewear 130. FIG. 1A illustrates an example of the gaming table 110 and the gaming eyewear 130 prior to play of the wagering game. FIG. 1B illustrates an example of the gaming table 110 after play has initiated for the wagering game. In some embodiments, the gaming table 110 is configured with displays at one or more of the player stations 101, 102, and 103 and/or at the area 104. In one embodiment, graphics of the hole cards 151, 152, and 153 and/or the community cards 105 can be presented on the displays. In other embodiments, one or more of the hole cards 151, 152, and 153 and/or the community cards 105 may be physical cards that are physically dealt to the player stations 101, 102, and 103 and/or to the area 104. In yet other embodiments, one or more of the hole cards 151, 152, and 153 and/or the community cards 105, may be displayed as virtual images via the gaming eyewear 130. In the example of FIG. 1B, to help illustrate various examples of presenting content via the gaming eyewear 130, the community cards 105 are not depicted as virtual images via the gaming eyewear 130, but instead are depicted as objects visible via the gaming eyewear 130, such as physical, or real-world, cards that have been physically dealt to the area 104 or which have been presented as graphical cards at a display at the area 104. The community cards 105 are visible via the gaming eyewear 130. The hole cards 151, 152, and 153, however, are presented as virtual images via the gaming eyewear 130 so that the hole cards 151, 152, and 153 appear associated with the player stations 101, 102, and 103 when viewed via the gaming eyewear 130. Furthermore, other objects can be viewed and/or presented via the gaming eyewear 130. For example, at the player stations 101, 102, and 103 the players can have some form of money for gambling during the wagering game, such as poker chips 111 (e.g., physical chips and/or graphical chips) which are used to represent money during the wagering game.

The gaming eyewear 130 is configured to be worn by a player (e.g., a first player) at the gaming table 110. The gaming eyewear 130 includes a frame 136 and a fastening mechanism to fasten, or hold, the gaming eyewear 130 to the players head. For example, the fastening mechanism can include appendages 137 configured to extend over the ears of the player and hold the eyewear onto the player's head over the player's eyes. In some embodiments, the fastening mechanism can further include a nose bridge 138 on which the frame 136 can rest on the face of the player, to hold the gaming eyewear 130 centered and steady in front of the eyes of the player. In other examples, the fastening mechanism can be a strap, a clip, a cap, etc. For instance, the gaming eyewear 130 may be goggles, contact lenses, a monocle, a visor, a viewer, or any other device with other forms of fastening mechanisms that hold the gaming eyewear 130 on, over, or near the player's eyes. The gaming eyewear 130 can further includes a viewing pane 139 with a transparent material 140 configured to be positioned in front of the eyes. The transparent material 140 may include transparent glass or plastic. In some embodiments, the gaming eyewear 130 includes projectors 131 that can project one or more images onto one or more surfaces of the transparent material 140. In other embodiments, however, the transparent material 140 may be a transparent display which includes electronic elements that present graphical images.

The gaming eyewear 130 can further includes multiple cameras. For example, first cameras 132 face inward towards the player's eyes to track movement of the player's eyes. Second cameras 135, on the front side of the gaming eyewear 130, face outward to detect an appearance of an environment in front of the gaming eyewear 130, including the gaming table 110, the player stations 101, 102, and 103, the area 104, the community cards 105, the poker chips 111, other players (e.g., the first and second players), a dealer, casino staff, other casino patrons, etc. The gaming eyewear 130 can further include a location unit 133, such as a global positioning system (GPS) device, to indicate a location of the gaming eyewear 130. The gaming eyewear 130 also includes a power switch 134 to power electronic components of the gaming eyewear 130, such as the projectors 131, the location unit 133, and the cameras 132 and 135.

In some embodiments, the gaming eyewear 130 can show virtual content related to the wagering game. The virtual content can appear related to objects visible via the gaming eyewear 130. For example, the virtual content can include virtual images that appear spatially related to the objects (e.g., to appear close to objects or to appear connected to the objects). The virtual content can appear related to the object based on a common type (e.g., a virtual image can be presented in a specific color that represents a type of content, which type is shared by a real-world object). The virtual content can appear related to objects based on a given value (e.g., a virtual image can have an assigned number which is also assigned to a real-world object). In one example, the gaming eyewear 130 can show virtual images that represent the hole cards 151, 152, and 153. For example, virtual images of hole cards 151 can represent hole cards for the player wearing the gaming eyewear 130 (e.g., the first player). A virtual image of the hole cards 152 represent hole cards for the second player assigned to the player station 102. The gaming eyewear 130 also presents a virtual tag 155 indicating that the player station 102 is assigned to the second player. A virtual image of the hole cards 153 represent hole cards for the third player assigned to the player station 103. The gaming eyewear 130 also presents a virtual tag 156 indicating that the player station 103 is assigned to the third player. The second and third players assigned to the player stations 102 and 103 can also have gaming eyewear to view the faces of their individual hole cards 152 and 153. During a round of play, the gaming eyewear 130 shows the fronts, or faces, of the first player's hole cards 151 as virtual images. The gaming eyewear 130 simultaneously shows, via the virtual images of hole cards 152 and 153, what appears to be the backs of the hole cards 152 and 153 for the second and third players. The gaming eyewear 130 also shows virtual images of community cards ("virtual community cards") 157. The virtual community cards 157 are virtual images that represent the physical, or real-world, presentation of the community cards 105. For instance, the gaming eyewear 130 can detect (e.g., via one or more of the cameras 135) specific characteristics of the community cards 105 and, based on the detected characteristics, associate the virtual community cards 157 with the community cards 105. The system can detect the characteristics of the community cards 105, or any other real-world object viewable via the gaming eyewear 130, by detecting at least one of (or a combination of) a specific marking, symbol, glyph, shape, color, texture, coded identifier, etc. belonging to the object. For instance, some objects may include a monotone color (e.g., green screen or blue screen), some objects may include bar-code symbols, some objects may have specific game-based graphics or symbols, some objects may include unique shapes, etc. Based on the characteristics, the system 100 can generate or select virtual content to present, such as specific suits and values to present on the faces of the virtual community cards 157. The system can also utilize the characteristics of the viewable objects to orient the presentation of the virtual content according to the location and orientation of the characteristics of the object. In some embodiments, the gaming eyewear 130 includes software and/or hardware configured to analyze symbols on the community cards 105 and to present the virtual community cards 157 (e.g., projected on the transparent material 140 via the projectors 131). In other embodiments, another device, such as a wagering game server, a wagering game machine, a mobile device, etc., is configured to receive graphical images of the real-world version of the community cards 105 taken via the cameras 135, analyze the graphical images, and communicate content for the virtual community cards 157, which the gaming eyewear 130 could then present (e.g. projected onto the transparent material 140).

The system 100 can further associate a virtual image, presented via the gaming eyewear 130, with an element of the environment viewable via the gaming eyewear 130. For example, the gaming eyewear 139 presents a virtual image of a virtual connector 158 that presents the appearance of a visible connection between any one of the virtual community cards 157, presented via the gaming eyewear 130, to the community cards 105 viewable via the transparent material 140 of the gaming eyewear 130. In another example, the gaming eyewear 130 also presents a virtual image of a circle 120 that appears to encircle the poker chips 111 at the player station 101. The gaming eyewear 130 also presents a virtual image of a dollar amount 121 that appears to be associated with (e.g., centered within) the virtual image of the circle 120. The dollar amount 121 represents a collective amount of money for the chips 111.

Furthermore, in the example described in FIGS. 1A-1B, the gaming eyewear 130 presents the virtual images of the hole cards 151, 152, and 153 as being associated with areas that correspond to locations of the gaming table 110 that correspond to the player stations 101, 102 and 103. When the player who is using the gaming eyewear 130 (i.e., the first player) indicates to look at his cards, the gaming eyewear 130 can cause the virtual image of the cards 151 to lift off of the table 110 similar to when a player lifts physical cards off of the table 110 to look at them. Thus, other players (e.g., the second player and third player) can see, via their gaming eyewear, virtual images if what appears to be the hole cards 151 for the first player being lifted off the gaming table 110. However, in other embodiments, the gaming eyewear 130 can present the virtual images of the cards 151 only to the first player, and not present a corresponding virtual image to the other players to indicate that first player looked at his cards 151.

The gaming eyewear 130 also shows a message 159 that indicates information about the wagering game. The message 159 may include, for example, information about a playing turn for the first player associated with the gaming eyewear 130 (e.g., the message 159 indicates when the first player's is eligible to bet, the message 159 indicates an amount of the first player's bet, the message 159 indicates a maximum or minimum limit of the player's bet, etc.). In some embodiments, the gaming eyewear 130 can present other information in the message 159, such as information and statistics related to the second player and the third player, information about wagering game rules, information about odds of obtaining a specific card hand or another gaming outcome, information about amounts of money or accomplishments obtained or possessed by other players in a group game, information about the environment, information about a player account, or any other information. In some embodiments, the gaming eyewear 130 can detect what a player is looking at within a field of view of the gaming eyewear 130. Depending on what the player is looking at (e.g., via the viewing angle or perspective viewed via the field of view of the gaming eyewear 130), the gaming eyewear 130 can change the information presented in the message 159, select or show specific types of content, etc.

Further, some embodiments of the inventive subject matter describe examples of gaming eyewear used in a networked wagering venue (e.g., an online casino, a wagering game website, a wagering network, a peer-to-peer network, an online social network, etc.) using a communication network. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the network(s) via computing devices. The multiple users can have accounts that subscribe to specific services, such as account-based wagering systems (e.g., account-based wagering game websites, account-based casino networks, etc.). For example, a gaming venue can network players at various locations (e.g., at home, in a casino, on travel, etc.) and present, via gaming eyewear, virtual images of gaming content.

Further, for purposes of the present detailed description, a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Furthermore, for purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Although FIGS. 1A-1B describe some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 2:
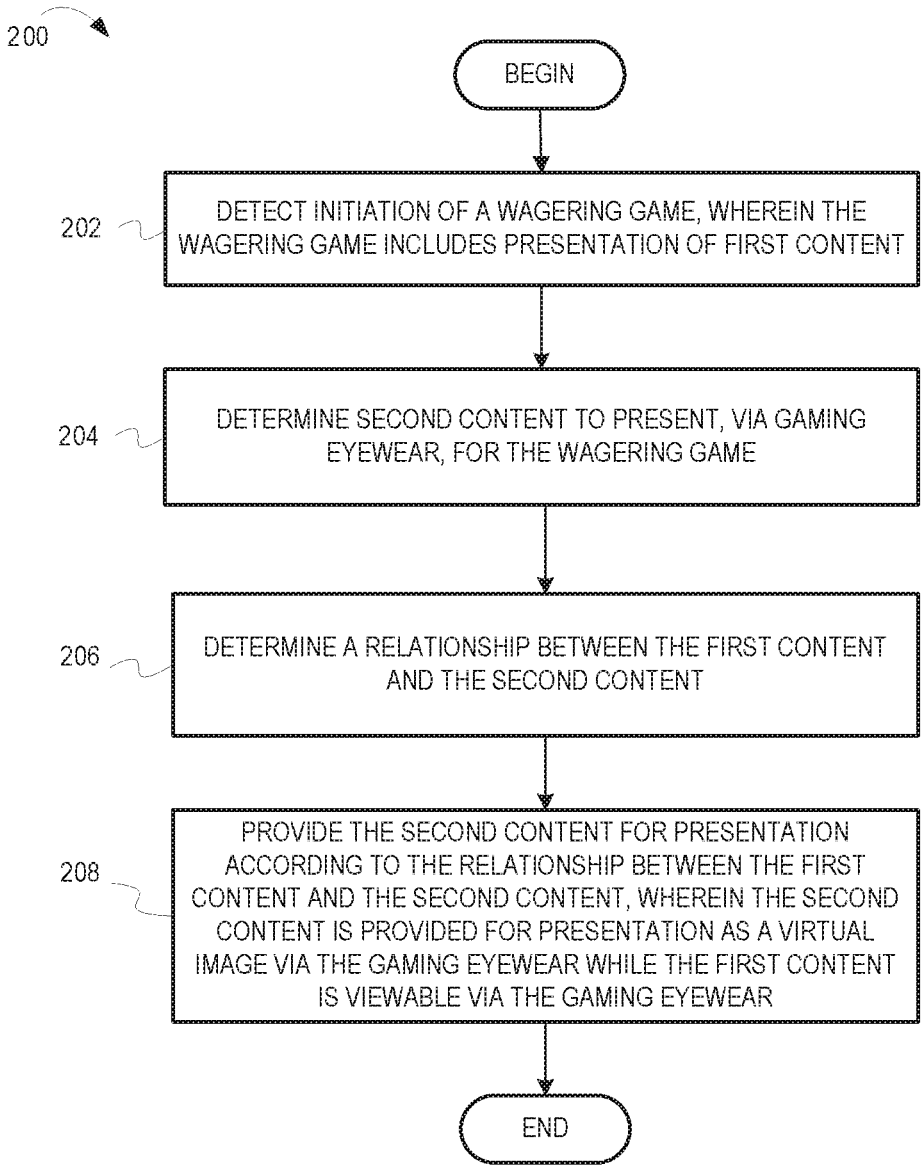
FIG. 2 is a flow diagram 200 illustrating presenting augmented reality content via gaming eyewear, according to some embodiments.
Figure 3:
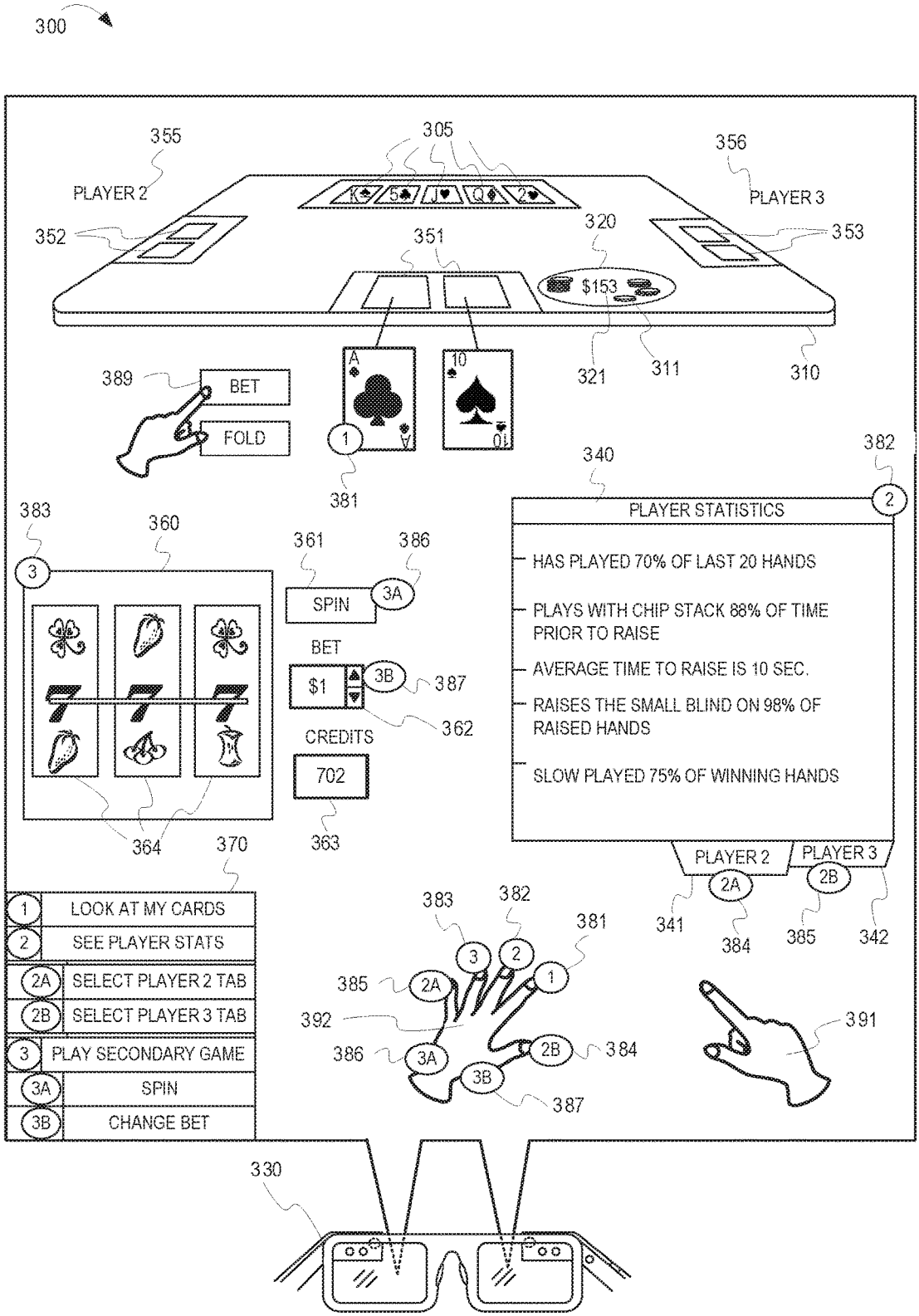
FIG. 3 is an illustration of presenting augmented reality content via gaming eyewear, according to some embodiments.

FIG. 2 is a flow diagram ("flow") 200 illustrating presenting augmented reality content via gaming eyewear, according to some embodiments. FIG. 3 is a conceptual diagram that helps illustrate the flow of FIG. 2, according to some embodiments. This description will present FIG. 2 in concert with FIG. 3. In FIG. 2, the flow 200 begins at processing block 202, where a wagering game system ("system") detects initiation of a wagering game, wherein the wagering game includes presentation of first content. For example, the system detects an initiation of a card game, a wagering game played via a wagering game machine, a group wagering game, or any other type of game that includes wagering. The wagering game includes playing elements, objects, etc. that are presented as part of game play.

The flow 200 continues at processing block 204, where the system determines second content to present, via gaming eyewear, for the wagering game. In some embodiments, the system determines the second content to present for the wagering game by accessing a wagering game controller for the wagering game. The wagering game controller can be included in a computing device incorporated with gaming eyewear or in another computer device that is connected to the gaming eyewear wirelessly or with a direct connection (e.g., a wagering game machine or a wagering game server). In some embodiments, the system detects an identity of a player associated with the wagering game. For example, the system can detect that a player swipes a player tracking card at a wagering game machine, at a gaming table, etc. Furthermore, the system can assign gaming eyewear to the player for use during the wagering game. In some embodiments, the gaming eyewear may have a unique identifier that links with the wagering game controller and which the wagering game controller can utilize as a display for the wagering game. The wagering game controller can have access to a game store, which includes content for the wagering game, as well as game programming, game rules, etc. During the wagering game, the system selects the appropriate gaming content to present at any given time.

The flow 200 continues at processing block 206, where the system determines a relationship between the first content and the second content. For example, in some embodiments, the system determines that the first content and second content are related to each other according to type, game rules, game mechanics, behaviors, physics, spatiality, etc. In some embodiments, the system can provide first and second content and/or present the first content and second content, in a manner that appears related to the second content based on the relationship between the first content and the second content. In some embodiments, the system calculates a field of view from a perspective of the gaming eyewear, determines that the second content is visible via the field of view, then positions a virtual image of the first content, within the field of view (e.g., on a portion of transparent material on the gaming eyewear), in a manner that is oriented and/or located relative to an orientation or location of the second content visible within the field of view. In some embodiments, the system detects a unique characteristic of the first content visible via the gaming eyewear and uses the unique characteristic as a reference point for the presentation of the second content (i.e., uses the unique characteristics as marker or glyph to which the second content can be associated in virtual space relative to the appearance of the first content viewable in real-world space as viewed via the gaming eyewear—see FIGS. 4 and 5 for some examples). In some embodiments, the system selects the second content based on the unique characteristic of the first content (e.g., see FIG. 6 for some examples). For instance, as described in FIG. 1, the system determines a gaming relationship between the first content and the second content by detecting a first set of symbols associated with community cards 105 and then presenting virtual images of hole cards 161 with a second set of symbols, wherein a combination of the first set of symbols and the second set of symbols form a combined game element that will be used to consider a game outcome. Based on the combined elements the gaming eyewear 130 can orient, animate, provide information about, or otherwise manipulate virtual images via the gaming eyewear 130 to assist the player, to display gaming outcomes, to present game features and data, or otherwise conduct the gaming session.

In some embodiments, the system presents, via gaming eyewear, an augmented reality by presenting virtual images that are incorporated with an appearance of real-world objects. In some embodiments, as described in FIG. 1, the gaming eyewear 130 has transparent material 140 through which real-world objects are visible. The gaming eyewear 130 then presents virtual images that appear to be incorporated into an appearance of the real-world objects that are viewable via the transparent material 140. For example, projectors 131 project virtual images onto a surface of the transparent material 140, which virtual images appear to be spatially tied to objects within the environment or present information about objects within the environment.

In other embodiments, the system includes gaming eyewear that can be enclosed and that does not have transparent material through which real-world objects are viewed. For instance, the gaming eyewear can capture an image of the environment (e.g., via a camera attached to the gaming eyewear) and present the image of the real-world environment on a screen or display within the enclosed portion of the gaming eyewear. The image of the environment includes images of real-world objects within the environment. Furthermore, the gaming eyewear generates virtual images to superimpose over, or embed into, the images of the real-world images presented on the enclosed screen or display.

The flow 200 continues at processing block 208, where the system provides the second content for presentation according to the relationship between the first content and the second content, wherein the second content is provided for presentation as a virtual image via the gaming eyewear while the first content is viewable via the gaming eyewear. In some embodiments, the system can present (and/or provide instructions to present) content either via a display at a wagering game device (e.g., via a display of a wagering game machine or wagering game table) as well as via gaming eyewear. FIGS. 1A and 1B illustrated some examples of presenting gaming content via a gaming table 110 and via gaming eyewear 130. In FIGS. 1A and 1B virtual images are presented via the gaming eyewear 130 while, simultaneously, other content for the wagering game was viewable via the gaming eyewear 130. For example, a first set of symbols (e.g., an "A" and "club" symbol and a "10" and "spade" symbols) are presented on the graphical image of hole cards 151 via the gaming eyewear 130. A second set of symbols (e.g., the "K" and "heart" symbols, the "5" and "club" symbols, the "J" and "heart" symbols, the "Q" and "diamond" symbols, and the "2" and "heart" symbols of the community cards 157) are presented on the community cards 157, such as via a display of the gaming table 110 viewable via the gaming eyewear 130. The system 100 tracks the combination of the first set of symbols and the second set of symbols to form a game outcome for the first player associated with the first player station 101. In other words, the content presented via the gaming eyewear 130 and the content viewable via the gaming eyewear 130 can have a relationship that is tied to game mechanics, rules, outcomes, etc. In some embodiments, the presentation of content is coordinated via the gaming eyewear 130 and the content viewable via the gaming eyewear 130. For example, the system 100 presents the virtual image of the hole cards 151 to be centered, and in some examples fixed in space, in relation to portions of the player station 101 viewable via the gaming eyewear 130 (e.g., fixed relative to a glyph at the player station 101). In other examples, a player may interact with content viewed via the gaming eyewear 130 and the gaming eyewear 130 presents a corresponding virtual image (e.g., the player flicks one of the poker chips 111 into a pot section at the gaming table 110 and when the chip lands in the pot section, the gaming eyewear 130 causes a virtual image of the chip to glow, move, spin, walk, speak, etc. or causes a virtual image associated with the pot section to interact in some way with the chip, such causing an appearance of a virtual image hand to protrude from the pot section and roll the chip between its fingers).

FIG. 3 illustrates additional examples of second content that can be presented as virtual images via gaming eyewear according to a relationship with first content viewable via the gaming eyewear. In FIG. 3, wagering game system ("system") 300 includes a gaming table 310 and gaming eyewear 330. The system 300 is configured to present content for a card game, as similarly described in FIG. 1. For example, the system 300 is configured to present primary gaming content (e.g., hole cards 351, 352, and 353 for first, second, and third players, community cards 305, poker chips 311 a shape 320 around the poker chips 311, a dollar amount 321, and indicators 355 and 356 for the second and third players) via the gaming table 310 (e.g., via displays on the gaming table 310) and/or via the gaming eyewear 330. The system 300 can present the primary gaming content as images via displays on the gaming table 310 and/or as virtual images via the gaming eyewear 330. One or more of the primary gaming content can be real-world objects that are presented physically at the gaming table 310. The primary gaming content is directly related to (e.g., used in) the primary wagering game for which the gaming table 310 is used. In addition to the primary gaming content, the system 300 can also present secondary gaming content. The secondary gaming content may be related to the primary wagering game but may not necessarily include game play elements. For example, the system 300 can present, via the gaming eyewear 330, a virtual image that relates to statistics of the primary wagering game (a "virtual statistics console") 340. The virtual statistics console 340 presents information related to the second and third player (e.g., statistical information related to an amount of play by the players, habits or patterns of the players, a history of betting or playing time by other players, a list of player tells, etc.). The system 300 can track identities of players and store information (e.g., identifiers, statistics, etc.) about the players. The gaming eyewear 330 can detect unique characteristics of a player via gaming eyewear (e.g., via a camera of the gaming eyewear 330) and, based on the unique characteristics, determine an identity of the players (e.g., via facial recognition techniques). In some embodiments, the gaming eyewear 330 can query a device on the network (e.g., a server) to obtain identification information or to determine the identity of the player. The gaming eyewear 330 can further query the device on the network for information about the player. The virtual statistics console 340 includes a first tab 341 that, when selected, presents the information for the second player. The virtual statistics console 340 also includes a second tab 342 that, when selected, presents information for the third player. The secondary gaming content may also include gaming content that is not directly related to the primary wagering game but instead is related to an independent wagering game that can be played simultaneously with the primary wagering game. For example, the system 300 can present, via the gaming eyewear 330, a secondary wagering game 360 that is playable by the first player, but that is played in a wagering game session separate from a gaming session for the primary wagering game (e.g., the primary wagering game and secondary wagering game 360 may withdraw credits from the same player account but may have separate session balances, separate game rules, separate game play elements, etc.). The secondary wagering game 360 includes slot reels 364, a spin control 361 (to activate a spin of the reels 364), a bet meter 362 (to indicate an amount of money or credits to bet for the secondary wagering game 360), and a credit meter 363 (to show an amount of credits available for play in the secondary wagering game session).

Figure 4:
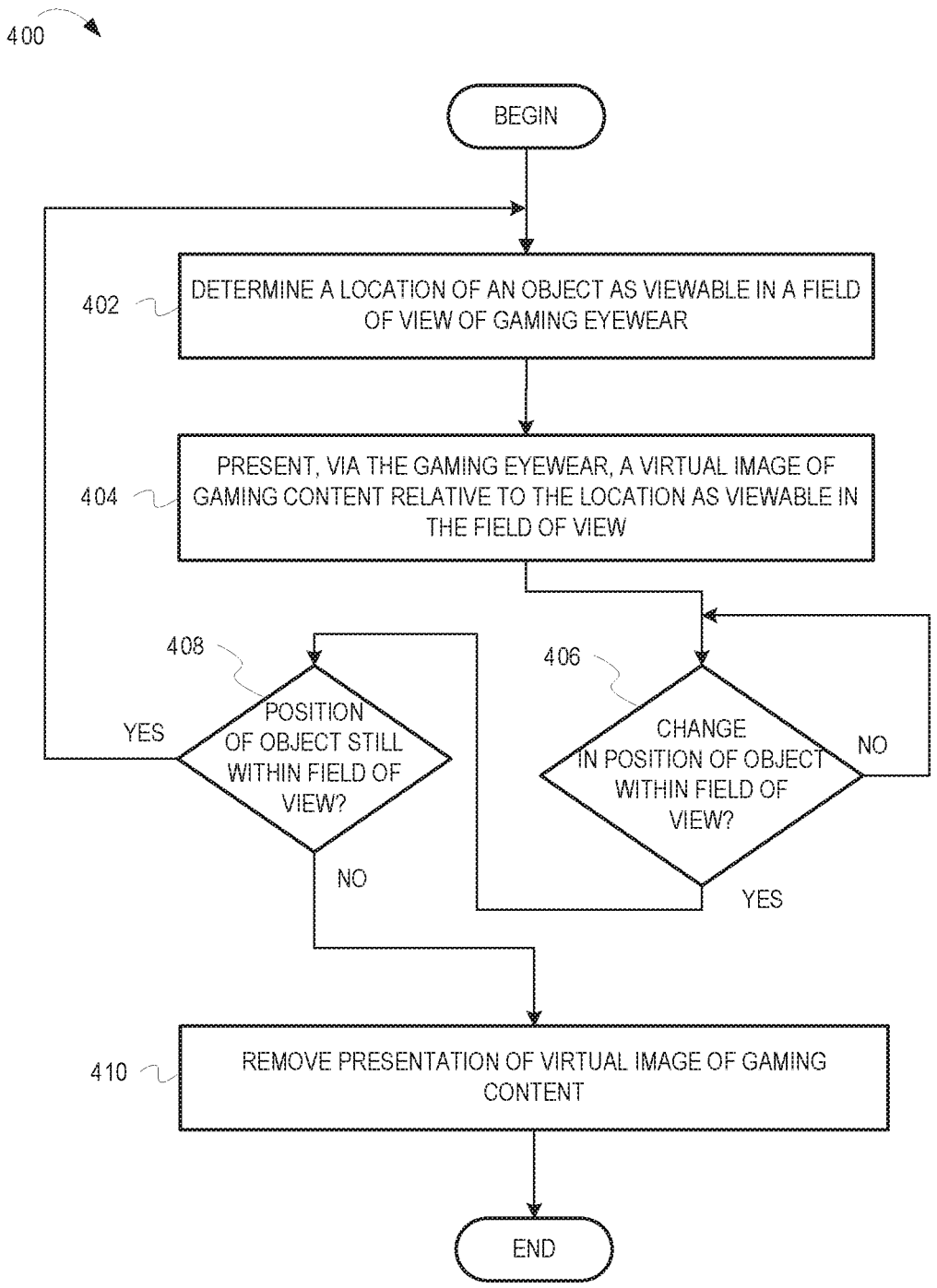
FIG. 4 is a flow diagram 400 illustrating presenting virtual images via gaming eyewear in relation to objects viewable via the gaming eyewear, according to some embodiments.
Figure 5A:
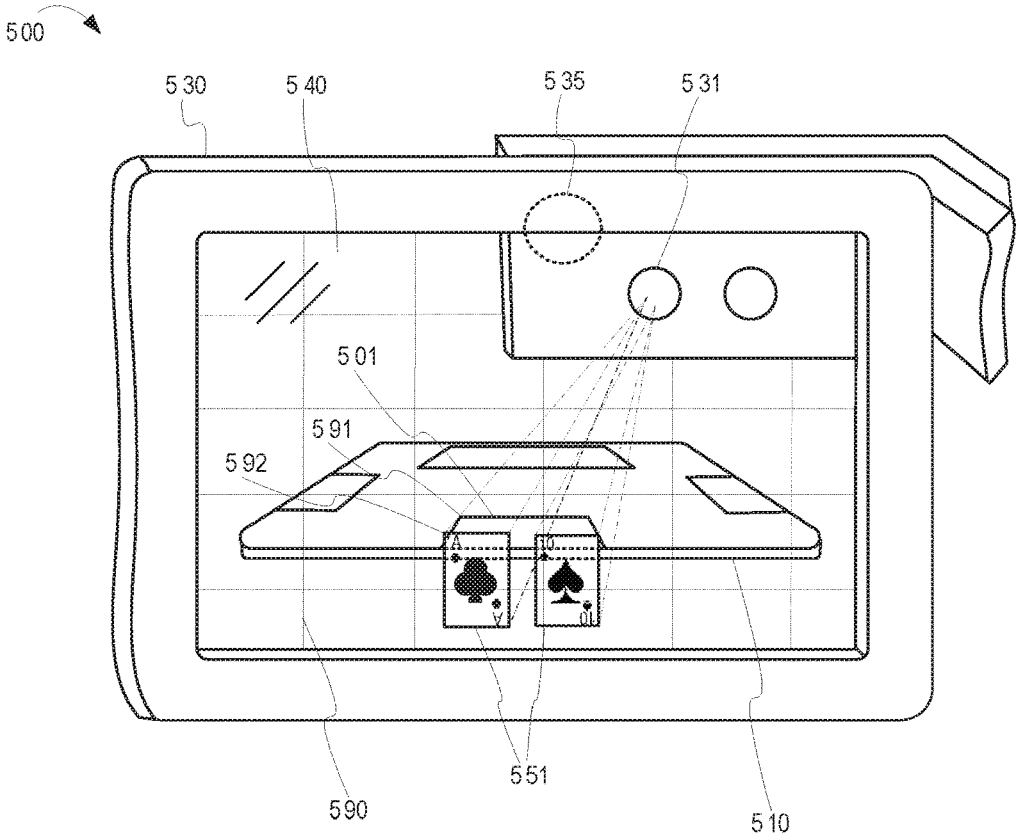
FIGS. 5A-5B are illustrations of presenting virtual images via gaming eyewear using a coordinate grid, according to some embodiments.
Figure 5B:
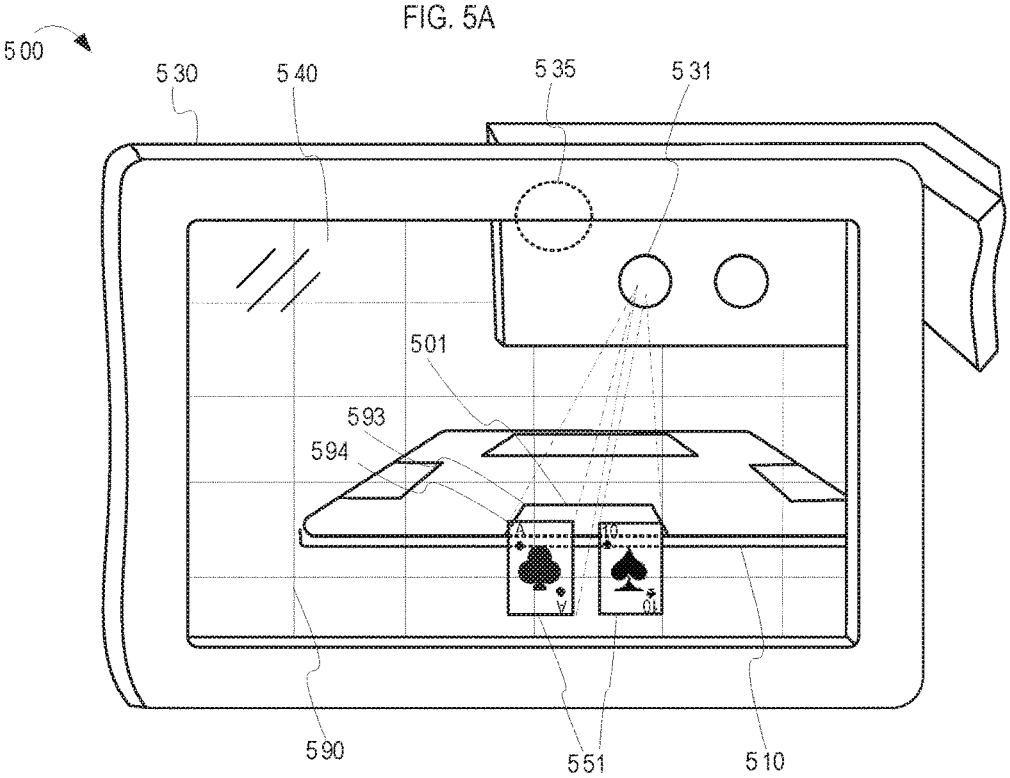

FIG. 4 is a flow diagram ("flow") 400 illustrating presenting virtual images via gaming eyewear in relation to objects viewable via the gaming eyewear, according to some embodiments. FIGS. 5A-5B and FIGS. 6A-6B are conceptual diagrams that help illustrate the flow of FIG. 4, according to some embodiments. This description will present FIG. 4 in concert with FIGS. 5A-5B and FIGS. 6A-6B. In FIG. 4, the flow 400 begins at processing block 402, where a wagering game system ("system") determines a location of an object as viewable in a field of view of gaming eyewear. For example, the system calculates a coordinate of an object viewable via gaming eyewear on a coordinate grid in a field of view of the gaming eyewear. In some embodiments, the system generates and overlays a coordinate grid that corresponds to every point viewable within the field of view (e.g., the coordinates correspond to points on a viewable section of the transparent material 140 of the gaming eyewear 130). FIGS. 5A-5B illustrate an example. In FIGS. 5A-5B a wagering game system ("system") 500 includes gaming eyewear 530 and a gaming table 510. Only a portion of gaming eyewear 530 (e.g., the right eye portion) is presented in FIGS. 5A-5B. The portion of the gaming eyewear 530 includes a transparent material 540 onto which a projector 531 can project virtual images. An outward facing camera 535 detects an environment in front of the gaming eyewear 530. The system 500 determines a field of view that is viewable through the gaming eyewear 530. For example, the portion of the environment that is viewable through the gaming eyewear 530 (e.g., as captured by the outward facing camera 535) is the field of view for the gaming eyewear 530. In the field of view, at least a portion of the gaming table 510 is viewable. The gaming table 510 includes a player station 501 also visible within the field of view of the gaming eyewear 530. The gaming eyewear 530 (or other device connected to the gaming eyewear 530) computes a transparent ("coordinate grid") 590 that divides the field of view into a discrete number of coordinates. In FIG. 5A, the system 500 determines that an upper left corner of player station 501 is at a first coordinate point 591 within the coordinate grid 590.

Returning momentarily to FIG. 4, the flow 400 continues at processing block 404, where the system presents, via the gaming eyewear, a virtual image of gaming content relative to the location (of the object) as viewable in the field of view. For example, the system presents a virtual image of the gaming content within a specific number of coordinate points from at least one of the coordinates for the object on a coordinate grid. The system determines a first coordinate on the coordinate grid that corresponds to a location of the second content as it appears within the field of view. The system further superimposes the virtual image of the first content using a second coordinate that is linked to the first coordinate. For example, in FIG. 5A, after the system 500 determines the first coordinate point 591, the system 500 determines a second coordinate point 592 that is within a given number of coordinates points form the coordinate point 591 on the coordinate grid 590. The projector 531 projects, onto the transparent material 540, a virtual image of the hole cards 551 so that an upper left corner of the hole cards 551 is at coordinate 592.

Returning momentarily to FIG. 4, the flow 400 continues at processing block 406 where the system determines whether a position of the object changes within the field of view. For example, when a player who is wearing the gaming eyewear moves his head the gaming eyewear moves accordingly. Because the gaming eyewear moves, the viewing perspective of the player changes, or, in other words, the field of view changes as viewed via the gaming eyewear. Furthermore, if the player moves his eyes, the view that the player sees through the gaming eyewear can change which can also cause the field of view to change. If the object in the environment does not move in a way that corresponds exactly to the change in the field of view, then the appearance of the object within the field of view will also appear to change position relative to the player's perspective. In other embodiments, even if the player's head or player's eyes do not move, the object itself may move position within the environment. The system can track the movement of the object within the environment. The system can further determine whether the player's head moves in a way that would correspond to the movement of the object in a way that would keep the object within the same position within the field of view. If the object moves and the player's movement does not compensate for that movement, the system determines that the position of the object appears to move within the field of view.

Still referring to the discussion of processing block 406, if the position of the object does not change within the field of view, the system continues to present the virtual image of the gaming content relative to the original location at which the object appears within the field of view (i.e., continues to present the virtual image at the second coordinate relative to the first coordinate). The flow 400 pauses, or loops, until the system detects a change to the position of the object within the field of view. If the system detects, at processing block 406, that the position of the object does change within the field of view, then the flow 400 continues at processing block 408. For example, in FIG. 5B, the gaming eyewear 530 moves, thus changing the field of view of the gaming eyewear 530. The system 500 determines that the position of the gaming table 510 moves relative to the gaming eyewear 530 and appears to shift sideways within the field of view of the gaming eyewear 530.

Returning momentarily to FIG. 4, at processing block 408, the system determines whether the position of the object is still within the field of view. If the object is still within the field of view, then the system returns to processing block 402 to re-determine the location of the object as viewable within the field of view (e.g., recalculate a third coordinate of the object on the coordinate grid and represent the virtual image of the gaming content at a fourth coordinate on the coordinate grid within the specific number of coordinate points relative to the third coordinate). However, if the position of the object is not still within the field of view, then the system, at processing block 410, removes the presentation of the virtual image of the gaming content via the gaming eyewear.

For example, in FIG. 5, after the system 500 determines that the gaming table 510 has moved within the field of view of the gaming eyewear 530, the system 500 determines that the player station 501, or the gaming table 510, is still within the field of view 501. In other words, the system 500 determines that the upper left corner of the player station 501 is still visible via the gaming eyewear 530. Consequently, the gaming eyewear 530 recalculates the location of the upper left corner of the player station 501 relative to the coordinate grid 590 and determines that the upper left corner of the player station 501 appears at a third coordinate 593 of the coordinate grid 590. The system 500, therefore, projects the virtual image of the hole cards 551 so that an upper left corner of the virtual image of the hole cards 551 appears, within the field of view, at a fourth coordinate 594, which is within the same number of coordinate points to the third coordinate 593 as the second coordinate 592 was to the first coordinate 591. In other words, when the player station 501 appears to move within the frame of reference of the gaming eyewear 530, then the system 500 causes the virtual image of the hole cards 551 to move in a way that corresponds to the movement of the player station 501. Thus, the system 500 causes the virtual image of the hole cards 551 to appear to remain fixed relative to the player station 501.

In some embodiments, if the player station 501 were to no longer appear within the field of view of the gaming eyewear 530 (e.g., the player looks entirely away from the gaming table 510 and/or something blocks the player's view of the gaming table 510), the gaming eyewear 530 could terminate the projection of the virtual image of the hole cards 551. Furthermore, when the player station 501 reappears within the field of view of the gaming eyewear (e.g., when the player looks back at the gaming table 510 or the obstruction to the player's view moves), if the player station 501 reappears within the field of view, the gaming eyewear 530, in some embodiments, can automatically begin to project the virtual image of the hold cards 551 relative to the location of the player station 501. In other embodiments, however, the gaming eyewear 501 can refrain from projecting the virtual image of the hole cards 551 until further notification (e.g., until detecting a user input that indicates a player's desire to again view the virtual image of the hole cards 551).

In other embodiments, instead of causing the virtual image of the hole cards 551 to appear to remain fixed relative to the player station 501, the system 500 could cause a virtual connector to the virtual image of the hole cards 551, or some other identifier of the virtual image of the hole cards 551, to remain fixed at a coordinate that represents the player station 501. For example, an identifier (e.g., numerical, textual, graphical, etc.) may represent the player station 501 within a virtual image of a legend. The virtual image of the legend may appear stationary within the field of view (e.g., in a lower or upper corner of the field of view of the gaming eyewear 530). The system 500 may cause a virtual image of the hole cards 551 to be tied to one or more coordinates of the legend. When the player station 501 no longer appears within the field of view, the system 500 can cause the virtual image of the hole cards 551 to disappear or remain visible until a player actively indicates (e.g., via a hand gesture) to remove the presentation of the virtual image of the hole cards 551.

Figure 6A:
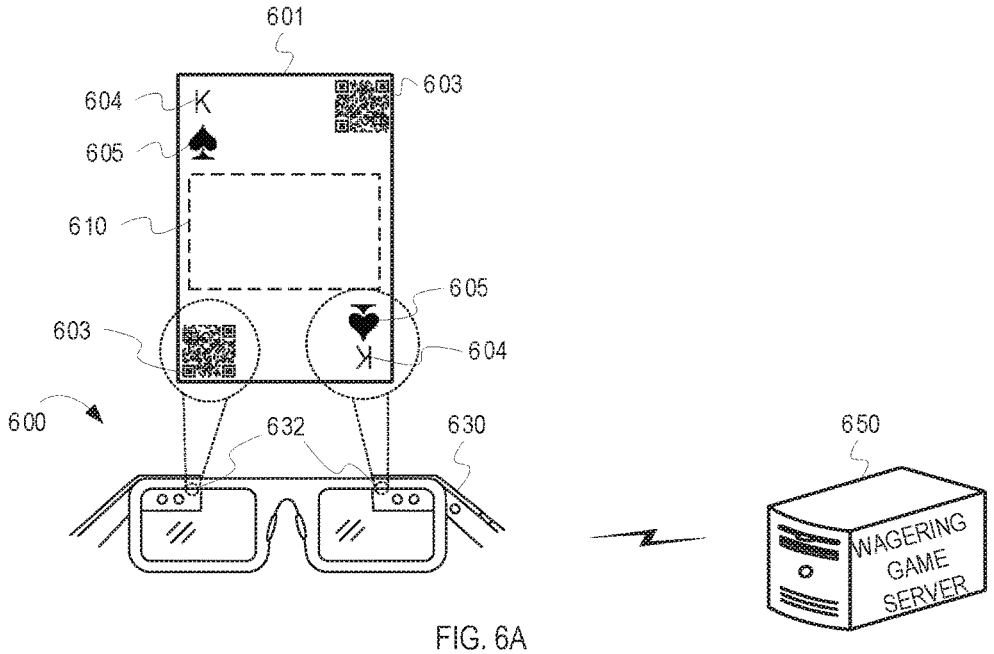
FIGS. 6A-6B are illustrations of detecting characteristics of objects and generating virtual content to present via gaming eyewear, according to some embodiments.
Figure 6B:
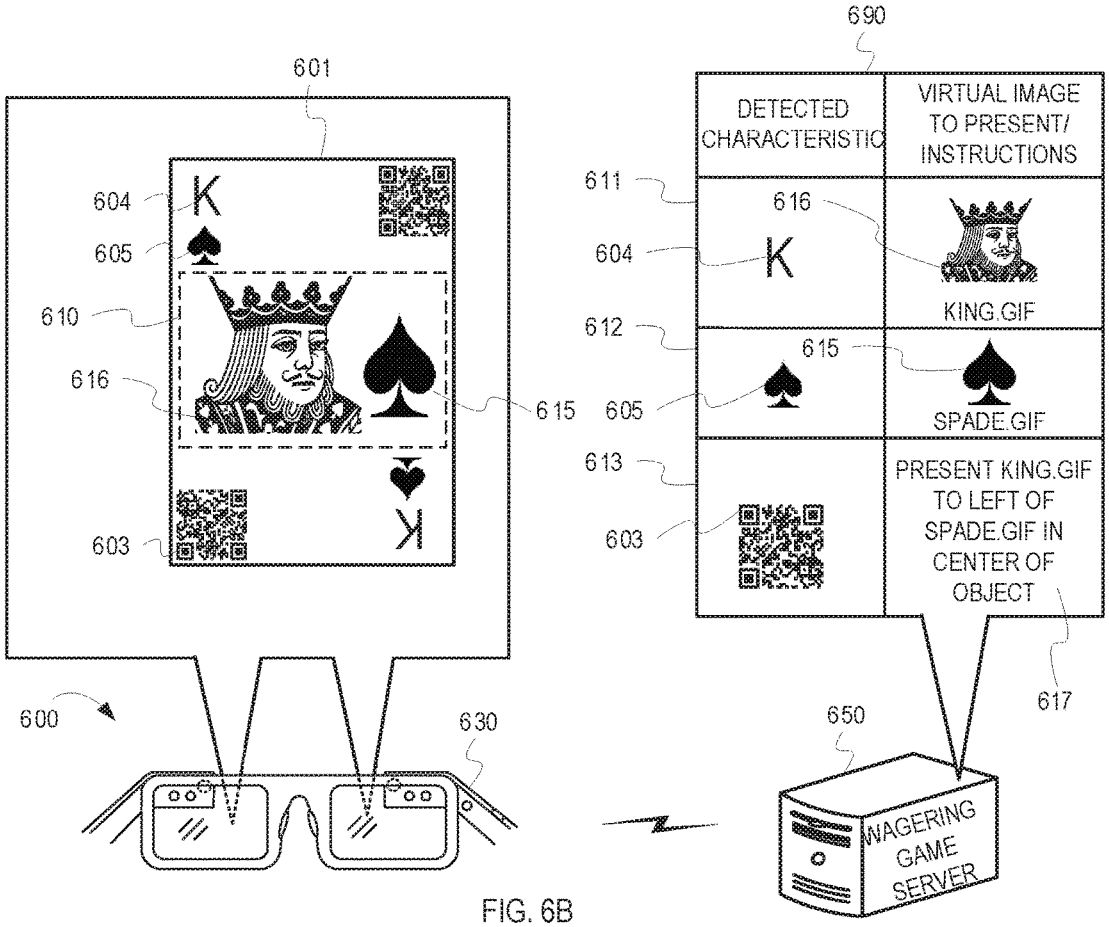

Returning momentarily to FIG. 4, at processing block 404, the system can present a virtual image of gaming content relative to a location of an object viewable within the field of view of gaming eyewear by detecting a characteristic of the object. Based on the characteristics, the system presents the gaming content relative to the object. For example, the system can detect an identity or distinct characteristic (e.g., via detection of a unique identifier) of an object viewable via gaming eyewear and then determining that gaming content is related to the identity or distinct characteristic of the object. The system can further position the virtual image of the gaming content relative to the object. FIGS. 6A-6B illustrate an example. In FIGS. 6A-6B a wagering game system 600 includes gaming eyewear 630 and a wagering game server 650. In FIG. 6A, the gaming eyewear 630 takes a picture of a card 601 (e.g., via one or more cameras, such as forward-facing cameras 632 attached to the gaming eyewear 630). In some examples, the system 600 analyzes the picture taken of the card 601 (e.g., via analysis logic/software on the gaming eyewear 630 and/or analysis logic/software on the wagering game server 650) and detects distinct, or unique, characteristics of the card 601, such as specific dimensions, shape, color, size, and other observable characteristics. Based on analysis of the unique characteristics of the card 601, the system 600 detects that the card 601 is a specific object used in a wagering game. In some embodiments, the system 600 detects unique glyphs, symbols, identifiers, etc., such as spade symbol 605 that represents a suit for the card 601 and a "K" symbol 604 that represents a rank for the card 601, which, in combination, represent a unique identifier for the card (i.e., the King of Spades). The system 600 also detects a two-dimensional barcode ("barcode") 603 included on the card 601. In some embodiments, the system 600 can measure the shape of the card 601 and detect the location of the corners of the card 601, and, based on the shape and location of the corners of the card 601, determine the location and orientation of the barcode 603, the location and orientation of the "K" symbol 604 and the spade symbol 604. It is noted, however, that in other implementations the system 600 can determine the orientation of the location and/or orientation of the unique characteristics by other methods. For example, instead of making measurements of shapes or other geometric characteristics of objects, the system can read the barcode 603 and detect metadata embedded within the barcode 603 to determine and identity of the object and/or to present or associate additional content with the object.

In FIG. 6B, the system 600 references a data store, such as one or more databases or data storage elements (e.g., database table 690), on the wagering game server 650. The system 600 uses the information obtained from observing the characteristics of the card 601 to query the data store (e.g., with search terms that describe the characteristic of the card 601) and, based on the query, determine a relationship with one or more records within the database table 690. The data within the records can indicate attributes of virtual content, such as 3D characteristics, behaviors, physics, orientation, composition, textures, appearance, etc. For example, the system 600 accesses a first record 611 that describes a relationship between the "K" symbol 604 and a graphic of a king (i.e., the king graphic 616). The system 600 accesses a second record 612 that describes a relationship between the spade symbol 605 and a spade graphic 615. The system 600 accesses a third record 613 that describes a relationship between the 2D barcode 603 and instructions 617 (e.g., parameters related to a spatial orientation) about where to position the king graphic 616 and the spade graphic 615 on the card 601. The system 600 then generates, via the gaming eyewear 630, virtual images of the king graphic 616 and the spade graphic 615 at positions on the card 601 according to the instructions 617. For example, the instructions 617 indicate to position the king graphic 616 and the spade graphic 615 in a center 610 of the card 601 that, when not viewed via the gaming eyewear 630, appears blank (as in FIG. 6A). In some embodiments, the system 600 positions, or superimposes, a virtual image over portions of an object (e.g., the card 601) that are not blank. In some embodiments, the system 600 can generate a contrast between a background portion of the object on which the virtual image is superimposed. For example, the system 600 can present the virtual image, via the gaming eyewear 630, with more brightness than the apparent brightness of the portion of the object on which the virtual image is superimposed and/or with a contrasting color than a color of the portion of the object on which the virtual image is superimposed.

Figure 7:
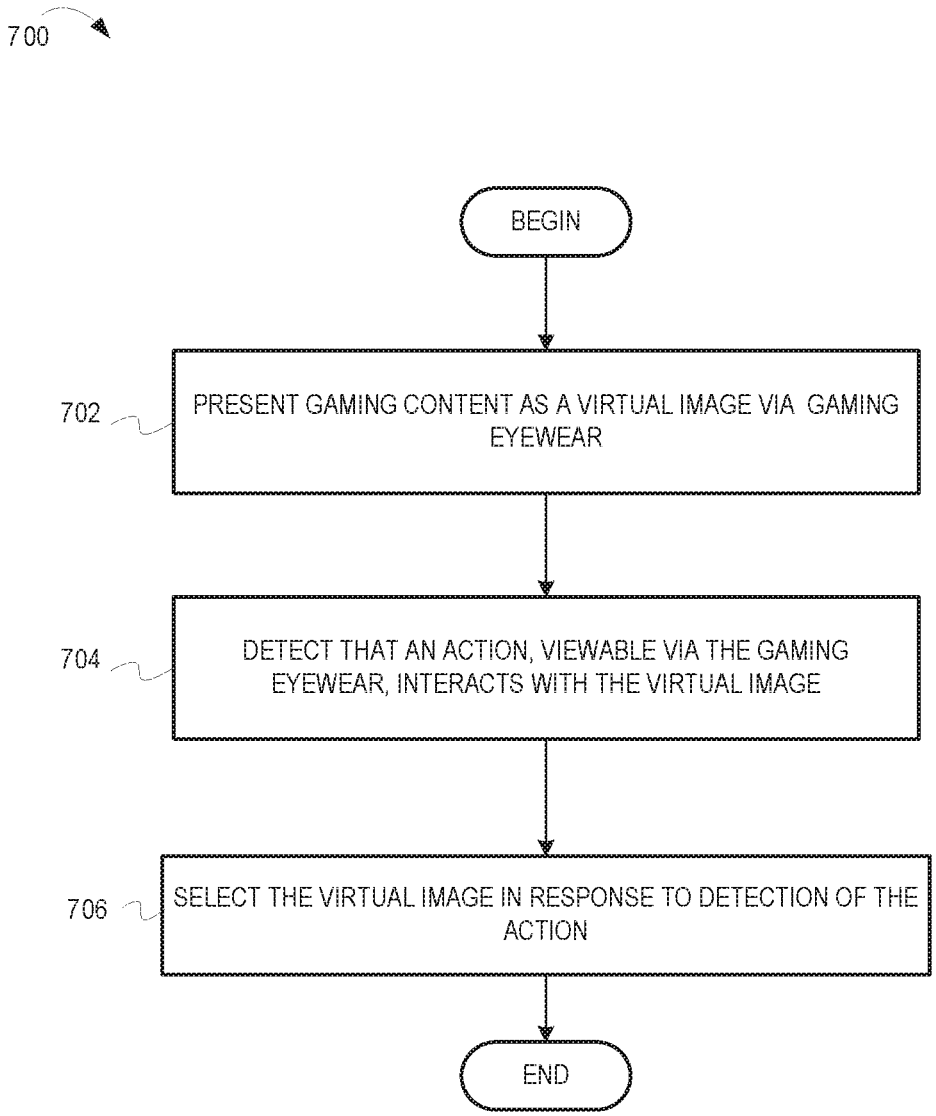
FIG. 7 is a flow diagram 700 illustrating selecting virtual content presented via gaming eyewear, according to some embodiments.

FIG. 7 is a flow diagram ("flow") 700 illustrating selecting virtual content presented via gaming eyewear, according to some embodiments. In FIG. 7, the flow 700 begins at processing block 702, where a wagering game system ("system") presents gaming content as a virtual image via gaming eyewear. The system can present the gaming content as the virtual image as described previously, such as in the description of FIGS. 1A-1B through FIGS. 6A-6B.

The flow 700 continues at processing block 704, where the system detects that an action, viewable via the gaming eyewear, interacts with the virtual image. For example, referring back to FIG. 3, the system 300 detects a player's hands (right hand 391 and left hand 392). The right hand 391 and left hand 392 are visible via the gaming eyewear 330 (e.g., within a field of view of the gaming eyewear 330). The system 300 places virtual images of numbers 381, 382, 383, 384, 385, 386, and 387 in a way that corresponds with (e.g., remain fixed relative to) different portions of the left hand 392 (e.g., to nails, fingers, thumb, knuckles, back, sides, wrist, etc.). The system 300 further presents virtual images of the numbers 381, 382, 383, 384, 385, 386, and 387 at one or more places within the field of view of the gaming eyewear 330, such as within a virtual legend 370, attached to virtual statistics console 340, attached to specific elements of the secondary wagering game 360, and/or attached to the virtual image of the hole cards 352. The system 300 detects (e.g., via analysis of movement of the right hand 391 and left hand 392) when a finger of the right hand 391 touches one of the parts on the left hand 392 that correspond to one of the virtual numbers 381, 382, 383, 384, 385, 386, and 387. In other words, the system 300 utilizes the left hand 392 as a real-world glyph that has a unique characteristic that can be detected and used to detect selection of virtual objects within the field of view of the gaming eyewear 330. Furthermore, it should be noted that the virtual images of numbers 381, 382, 383, 384, 385, 386, and 387 can be other symbols, such as graphics that appear similar to the objects in the environment. The graphics can be customized to the player.

Returning momentarily to FIG. 7, the flow 700 continues at processing block 706, where the system selects the virtual image in response to detection of the action. For example, in FIG. 3, in response to when the finger of the right hand 391 touches one of the parts of the left hand 392, the system 300 selects one of the virtual objects that corresponds to the one of the virtual numbers 381, 382, 383, 384, 385, 386, and 387 associated with the part of the left hand 392 that was touched. The legend 370 indicates, for example, that touching the portion of the left hand 392 that corresponds to the virtual image of the number 381 will cause the system 300 to show the virtual image of the hole cards 352. The legend 370 also indicates that touching the portion of the left hand 392 that corresponds to the virtual image of the number 382 will cause the system 300 to present the virtual statistics console 340. The legend 370 further indicates that touching the portion of the left hand 392 that corresponds to one of the virtual images of the numbers 384 or 385 will select one of the tabs 341 or 342. The legend 370 further indicates that touching the portion of the left hand 392 that corresponds to the virtual image of the number 383 will show the secondary wagering game 360. Further, touching the portion of the left hand 392 that corresponds to any of the virtual images of the numbers 386 and 387 will cause the system 300 to either select the spin control 361 (causing the system 300 to place a bet and spin the reels 364) or to select the bet meter 362 (to change a bet value).

It should be noted that although FIG. 3 illustrates selecting of a virtual object by tracking the placement and actions of a user's hands viewable via gaming eyewear, other methods can be used to select virtual content. For example, a user may place a finger on a touch pad causing a virtual image of a cursor or pointer to appear within the field of view of the gaming eyewear. The user can then move the virtual image of the cursor or pointer to a virtual object presented via the gaming eyewear and double-click a button on the touchpad, thus indicating a selection of the virtual object.

Additional Example Embodiments

According to some embodiments, a wagering game system ("system") can provide various example devices, operations, etc., to present augmented reality content via gaming eyewear. The following non-exhaustive list enumerates some possible embodiments.

Figure 8:
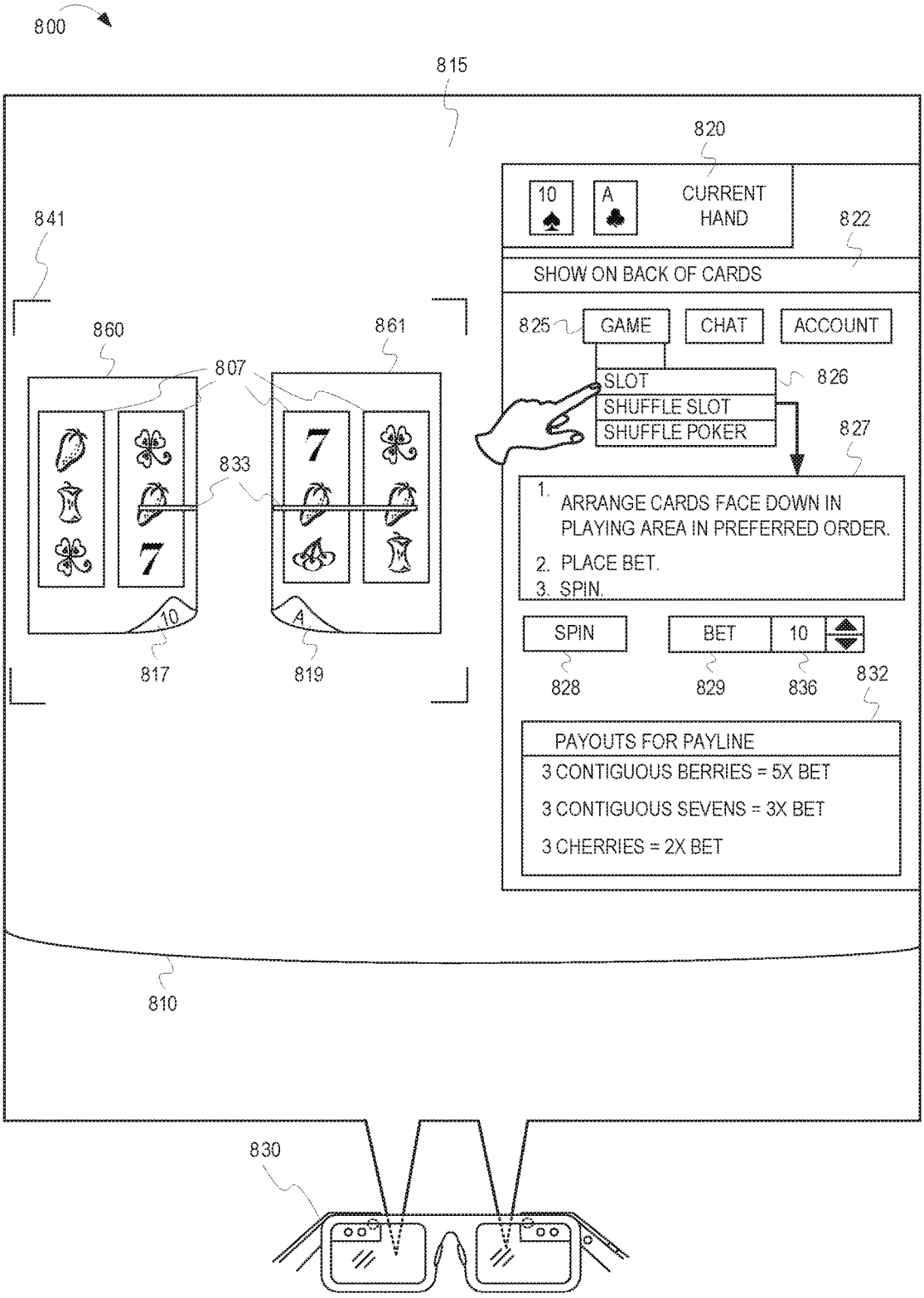
FIG. 8 is an illustration of presenting secondary gaming content via gaming eyewear, according to some embodiments.

FIG. 3 illustrated one example of presenting a secondary wagering game 360. The virtual images of the secondary wagering game 360 are presented via the gaming eyewear 330 in a way that does not appear to be associated with a particular real-world object. In other embodiments, however, such as in FIG. 8, secondary games presented via gaming eyewear 830 are presented in a way that is associated with objects viewable via the gaming eyewear 830. In FIG. 8, a wagering game system ("system") 800 includes an gaming table 810 with at least one area 815 where a player can place playing cards 860 and 861. A front side 817 of card 860 can include a card value (e.g., the rank "10") that relates to the primary card game (e.g., Texas Hold 'Em Poker, Black Jack, etc.) played at the gaming table 810. On the front side 819 of the card 861 is another card value (e.g., the rank of "Ace"). The card values comprise the player's hand for the primary game. In some embodiments, the system 800 presents virtual images via the gaming eyewear 830, which virtual images are associated with the backs of the cards 860 and 861 and/or are associated with the area 815. The system 800 includes a wagering game controller associated with the gaming eyewear 830. In some examples, the gaming eyewear 830 includes the wagering game controller. In other examples, the gaming table 810 includes the wagering game controller and the gaming eyewear 830 communicates with the gaming table 810 (e.g., the gaming eyewear 830 plugs into a port of the gaming table 810 and/or communicates wirelessly with the gaming table 810). In yet other examples, a wagering game server includes the wagering game controller and the gaming eyewear 830 communicates wirelessly with the wagering game server. The gaming eyewear 830 can present the virtual images, for example, in ways previously described (e.g., via graphical presentation on a display of the gaming eyewear 830, via projection onto lenses of the gaming eyewear 830, etc.). The gaming eyewear 830 shows information 820 related to the primary game, such as information about the player's current hand. The gaming eyewear 830 also presents information about secondary content that can be presented via the area 815, such as on the back of the cards 860 and 861. The secondary content can include a secondary wagering game, such as a slot game with virtual slot reels 807 that the gaming eyewear 830 presents as being on the back of the cards 860 and 861. The gaming eyewear 830 presents a secondary content section 822 (e.g., with the appearance of virtual framing that organizes the information in the secondary content section 822 and/or separates it from information 820 about the primary game). The secondary content section 822 can show options for presenting secondary content on the cards 860 and 861. The options can include virtual images of buttons that relate to the different types of secondary content, such as games, chat features, account information, etc. (e.g., virtual game button 825). The virtual game button 825, for example, can include a virtual game menu 826 that presents the types of secondary games available to be presented on the cards 860 and 861. The system 800 can determine the available secondary games based on a number of factors including the number of cards 860 and 861 in the playing area 815, an amount of game play elements (e.g., virtual slot reels 807) that need to be presented on the cards 860 and 861, player preferences, player history, primary game rules or restrictions, marketing data, time of day, location in a casino, special offers, comps, or other information. The secondary content section 822 can include a virtual instruction section 827 that explains how to use the cards 860 and 861 for a secondary game selected from the virtual game menu 826. For example, for a "shuffle slot" game, a player may need to arrange their cards 860 and 861 in a preferred arrangement, or player-selected configuration. Once the player has arranged the cards 860 and 861, the player can place bets on the slot game using virtual betting controls (e.g., virtual betting button 829 and virtual betting meter 836). The player can then spin the virtual slot reels 807 (e.g., via the virtual spin button 828, which, when selected, places a bet and spins the virtual slot reels 807). The virtual slot reels 807 appear on the back of the cards 860 and 861. Based on the secondary game selected, such as the shuffle slot game, the arrangement of the cards may matter as slot reel elements line up in specific configurations. For example, according to the virtual payout chart 832 for the card game, contiguous numbers of playing elements pay out. So, for example, if the cards 860 and 861 are arranged properly, three virtual strawberries may appear to line up contiguously along a virtual pay line 833. In a reverse configuration, however, (i.e., if the cards 860 and 861 were reversed in their position) the virtual strawberries would not line up contiguously. Thus, the slot game can depends on the arrangement or "shuffle" of the cards 860 and 861 by the player. The system 800 can determine if a player moves the cards 860 and 861 in the area 815 and force a tilt. In other embodiments, the system 800 may allow a player to reposition the cards 860 and 861 after a spin completes to get potential payouts. Based on game rules (e.g., whether a player can or cannot reposition cards, whether a player plays a shuffle slot game versus a normal slot game, etc.) the system 800 can present different payouts based on the risks or gamble involved. The system 800 can also modify bet amounts based on activity or events related to the primary game. For example, the system 800 may increase the betting possibilities on the secondary game based on bet amounts for the primary game (e.g., average bets for a player in the primary game, current bet amounts for the betting round in the primary game, bet limits in the primary game, etc.). FIG. 8 shows four virtual slot reels 807 presented on the cards 860 and 861 (i.e., two on each card 860 and 861). In some embodiments, the number of virtual slot reels, or other playing elements, can be limited to the number of cards used in the primary game. Furthermore, the number of virtual slot reels 807 can be limited based on how the cards are overlapped. For example, if a player places their cards 860 and 861 to be overlapped so that card 860 is on top of, and primarily covering, card 861, then the system 800 can select a number of virtual slot reels 807 based on the amount of space viewable on the card 860 via the gaming eyewear 830.

Furthermore, in some embodiments, the system 800 can present the secondary game directly onto the surface of the gaming table 810 in addition to, or instead of, presenting the secondary game onto the back of the cards 860 and 861. In some embodiments, either the cards 860 and 861, or a section of the gaming table 810, can include a visible, physical mark (e.g., frame markers 841) that the gaming eyewear 830 can utilize as a type of environmental reference point(s) by which to orient the presentation of virtual images for the secondary content. For example, the frame markers 841 may be the object described in the flow 400 of FIG. 4. In some embodiments, the system 800 utilizes more than one object (e.g. multiple frame markers, a frame marker and an edge of the gaming table 810, etc.) to orient the placement of the virtual image in virtual space relative to physical space. Multiple objects provide multiple perspective points so that the system can present the virtual image according to length, width, and depth of the field of view viewable via the gaming eyewear 810.

In some embodiments, a wagering game system ("system") can present, via gaming eyewear, modifications to game elements of a primary wagering game or additional elements on primary game elements that can be used as a secondary game. For example, for a poker game, the system may cause one or more of virtual cards to be wild cards, which can be used to represent any suit or value. In some embodiments, the system can detect ranks and suits of virtual cards and use the ranks or suits in a secondary card game presented via the gaming eyewear. In another example, gaming eyewear can present additional paylines on reels of a primary wagering game. The additional paylines can be part of the primary game or can be associated with a secondary game that is independent from the game math for the primary wagering game, but that uses the reel symbols presented in the primary game.

Presentation, Via Gaming Eyewear, of Content, Information, or Communication from Wagering Game Machines.

Figure 9:
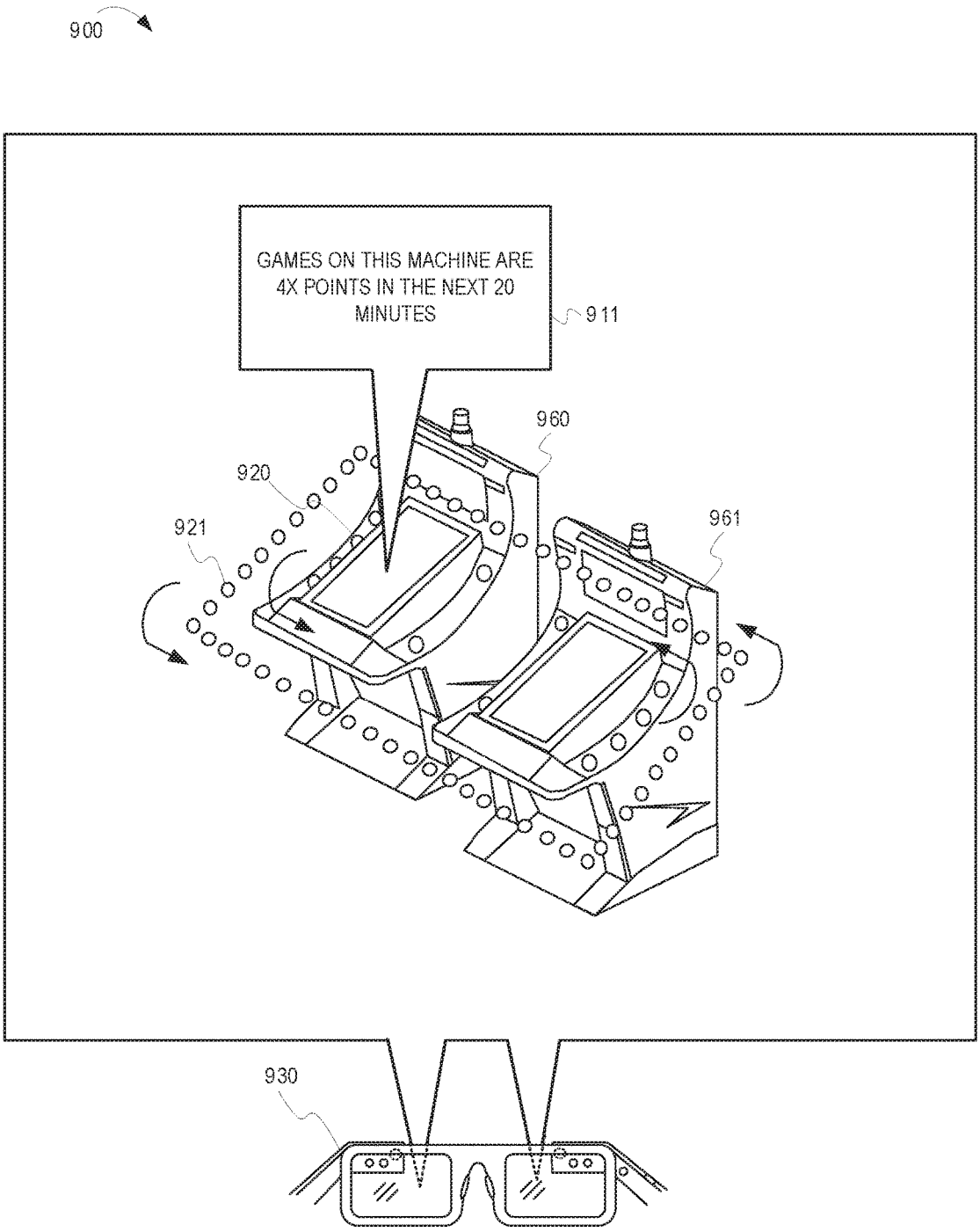
FIG. 9 is an illustration of presenting augmented reality content for wagering game machines via gaming eyewear, according to some embodiments.

FIG. 9 illustrates an example wagering game system ("system") 900 that includes wagering game machines 960 and 961 and gaming eyewear 930. When one of the wagering game machines 960 is viewed via the gaming eyewear 930, the gaming eyewear 930 presents a virtual image of a message 911. The message 911 indicates information about the wagering game machine 960, such as information that advertises specific time-based features of the wagering game machine 960. The information presented in the message 911 can be anything related to the wagering game machine 960, anything related to games available via the wagering game machine 960, or any information in general that is to be communicated to the user of the gaming eyewear 960. For instance, in some embodiments the system 900 detects the identity of the user who wears the gaming eyewear 930, detects information about the player's playing habits, preferences, or other information stored in a player profile, and then customizes the content of the message 911 to the player.

In some embodiments, the gaming eyewear 930 detects an event that occurs at one or more of the wagering game machines 960 and 961 and, in response, presents a virtual image via the gaming eyewear 930 that corresponds to the event. For instance, in some embodiments, the system 900 detects that the wagering game machines 960 and 961 present a light show where lights 920 blink in a specific pattern so that they appear to move in a clockwise fashion across the sides, top, and bottom of the wagering game machines 960 and 961. Based on the blinking pattern of the lights 920, the gaming eyewear 930 presents a virtual image of lights 921 that have a similar blinking pattern that appear to move in a clock-wise fashion.

Furthermore, in some embodiments, the system 900 can present, via gaming eyewear 930, statistics related to the wagering game machines 960 and 961. For example, when the gaming eyewear 930 is in a specific mode it can present information related to when the wagering game machines 960 and 961 last hit a jackpot or last paid out a specific amount of money. In some embodiments, the gaming eyewear 930 can present a casino floor map that shows virtual colors that appear to emanate from wagering game machines 960 or 961 based on their statistics (e.g., a machine that has not paid out a win for a long time appears to glow red when viewed via the gaming eyewear 930, whereas a machine that has recently had a win can appears to glow green).

Figure 10:
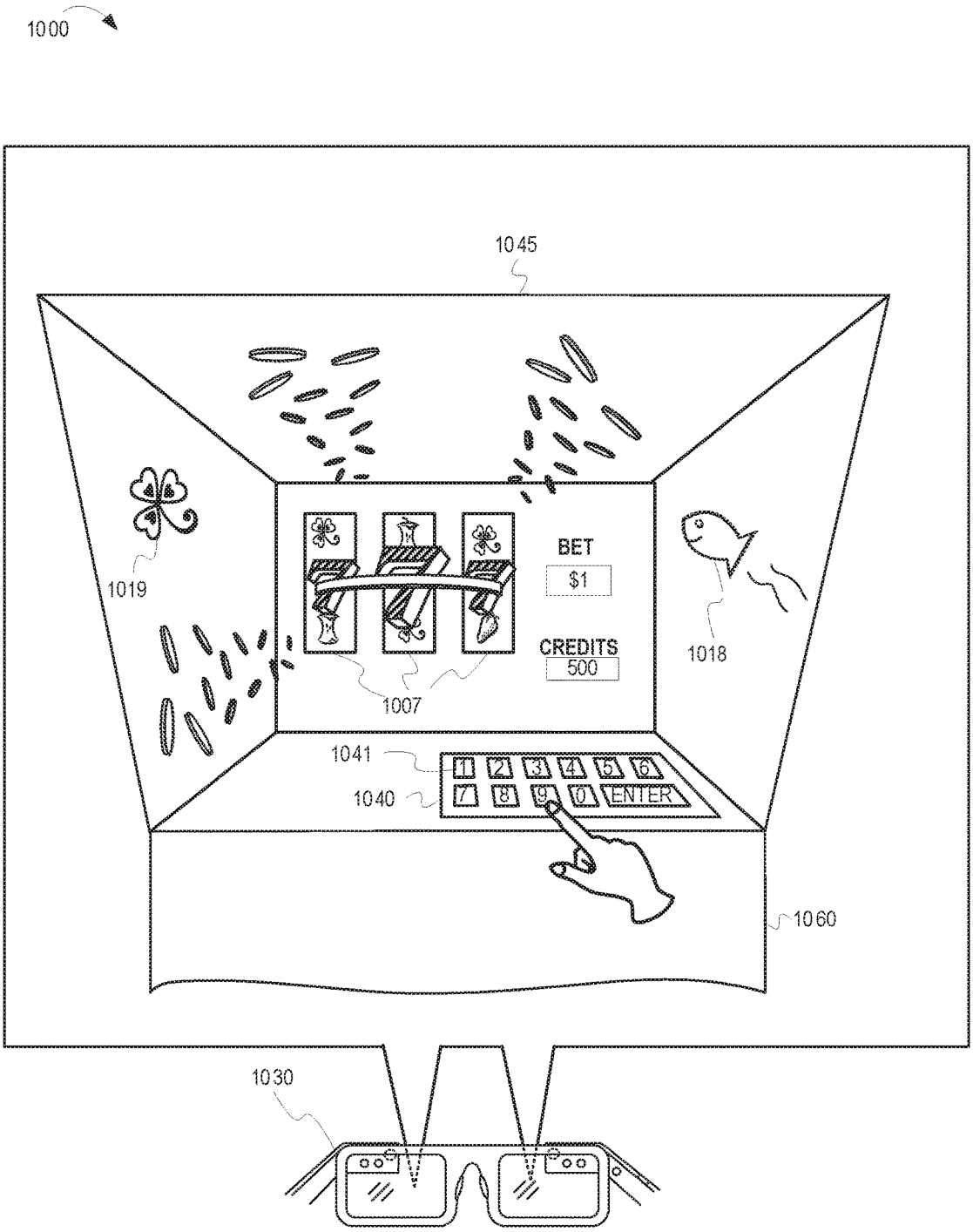
FIG. 10 is an illustration of presenting augmented reality content for a primary wagering game via gaming eyewear, according to some embodiments.

In some embodiments, as in FIG. 10, a wagering game system ("system") 1000 includes gaming eyewear 1030 and a wagering game machine 1060. The gaming eyewear 1030 is configured to present three-dimensional (3D) virtual images of content (e.g., a 3D shamrock 1019, a 3D fish 1018, and 3D reels symbols of reels 1007). For example, the gaming eyewear 1030 can be configured to present stereoscopic images on different lenses of the gaming eyewear 1030, thus generating a stereoscopic 3D effect. For instance, the gaming eyewear 1030 can present two anaglyph images. A first of the anaglyph images represents a left eye view and can be presented onto a left lens of the gaming eyewear 1030. A second of the anaglyph images represents a right eye view and can be presented on a right lens of the gaming eyewear 1030. The left eye view is slightly offset from the right eye view so that when both anaglyph images are seen through the gaming eyewear 1030, simultaneously via the left and right eye, the composite image appears to be a stereoscopic 3D image having stereoscopic depth.

The wagering game machine 1060 can include barriers 1045 (e.g., walls, screens, etc.) that provide contrast for the images presented via the gaming eyewear 1030.

Furthermore, in some embodiments the gaming eyewear 1030 presents secure content that is only visible to a player wearing the gaming eyewear 1030. For example, the system 1000 detects and verifies an identity of the player (e.g., via access to a player account logged in to the wagering game machine 1060, via an identifier of the gaming eyewear 1030 that is assigned to the player account, via a retinal scan of the player wearing the gaming eyewear 1030, via entry of a password specified by the player, etc.). In response to detecting and verifying the identity of the player, the gaming eyewear 1030 presents the secure content. For example, the gaming eyewear 1030 presents a security console 1040 with virtual images of keys 1041, which appear exclusively via the gaming eyewear 1030, thus providing enhanced security for keying in pins or passcodes because other individuals cannot see the position or values of the virtual images of the keys 1041.

Additional Secondary Content to Present Via Gaming Eyewear.

In addition to wagering game content, the system can present any other type of content that may or may not be related to wagering games, such as security information, privacy content, help information, advertising and marketing offers, mobile device data (e.g., data read from a personal mobile device), etc. For example, in some embodiments, the system can detect a text message received via a smartphone and present the text message via the gaming eyewear.

In some embodiments, the gaming eyewear detects values and coverts or translates them. For example, the gaming eyewear detects a value of money wagered, or won, and translates the amount to a different currency value (e.g., a bet of 1 Euro is converted to a U.S. Dollar amount and presented via the gaming eyewear).

In some embodiments, the system can detect an amount of credits that a player has left and, based on a rate of play, generate an estimated amount of time before the amount of credits are spent.

In some embodiments, the system presents, via gaming eyewear, menu items, prices, credits amounts, loyalty points, player status, etc. For example, gaming eyewear can present a meter of loyalty points and indications of what the loyalty points can be used for within a casino. For example, when a player walks by a vendor, the gaming eyewear can show a list of prices for vendor products and/or whether loyalty points can be used for any of the items.

Tracking Player Activities and Interactions Via Gaming Eyewear.

In some embodiments, the system tracks information about a player based on what gaming eyewear detects over time (e.g., via a camera or sensors of the gaming eyewear). For example, in some embodiments the system tracks a player's gestures to perform actions (e.g., to perform gaming actions, to communicate with wagering game controller or individual, to order drinks, etc.). For example, in some embodiments, the system detects, via gaming eyewear, pre-specified gestures indicated by the player and stored in a player account (e.g., stored as a setting of the player account to indicate that performance of the gesture indicates one or more of an interaction with virtual content and/or to perform a gaming function). The gestures can be custom to the player and shared with other player accounts. For example, the system includes controls for a first player to store, in a first player account, specific gestures that are recognizable by first gaming eyewear worn by the first player. The system also provides controls for the first player to specify, via the first player account, a second player account. Gaming eyewear worn by a second player assigned to the second player account perceives a gesture made by the first player. The second gaming eyewear accesses the first player account and determines what the gesture means based on information in the first player account. The second gaming eyewear then presents, via the gaming eyewear, a virtual image that indicates the meaning of the gesture. In some embodiments, the system can detect, via gaming eyewear, a gesture made by a player and, in response, perform specific actions in a game (e.g., spin reels, make a bet, bet on cards, fold a hand, etc.), perform specific services (e.g., order a drink, make a reservation, sent a text message, etc.) or perform any other activity on the system.

In some embodiments, the system can store in memory a history of specific objects at which a player has looked via the gaming eyewear. Based on the history, the system can customize content, present messages, determine ads that were viewed by a player, determine how much a player has bet over time, determine a type of game or machine played, determine how much a player has spent and how the player spent the amount of money, detect a preferred type of machine or brand of wagering games, recognize betting patterns of a player, etc.

In some embodiments, the gaming eyewear can respond to player input related to the presented content. For example, the gaming eyewear can present menus, folders, etc. by which the player can drag and drop virtual content presented via the gaming eyewear (e.g., drag and drop into a virtual image of a folder to categorize the content, drag and drop into a virtual image of a recycle bin to remove presentation of a specific type of content, etc.).

Conducting Financial Transactions Via Gaming Eyewear.

In some embodiments, the system connects gaming eyewear to an account server for transactions of wagers initiated via use of the gaming eyewear. For example, as described previously, the gaming eyewear can present a virtual object that, when interacted with will communicate information to a wagering game controller to conduct financial transaction of wagers for the wagering game. For example, as described in FIG. 3, when a player selects the spin control 361 and/or the bet meter 362 via virtual images of the numbers 386 and 387 presented via the gaming eyewear 330, the system 300 communicates with a wagering game controller that the secondary wagering game 360 initiated a spin of the reels 364. The system 300, therefore, transacts the wager using a player's gaming account. The system 300 can further add any winnings to the player account. The wagering game controller can detect the placement and transaction of the wager and cause the reels 364 to spin and present a gaming outcome that was randomly generated. Further, in another example, for the primary wagering game, the system 300 detects a player interaction with a virtual image of a bet control 389 for the primary wagering game. Interaction with the virtual image of the bet control 389 can initiate a wager for the card game presented via the gaming table 310.

Example Operating Environments

This section describes example operating environments, systems, networks, etc. and presents structural aspects of some embodiments.

Wagering Game System Architecture

Figure 11:
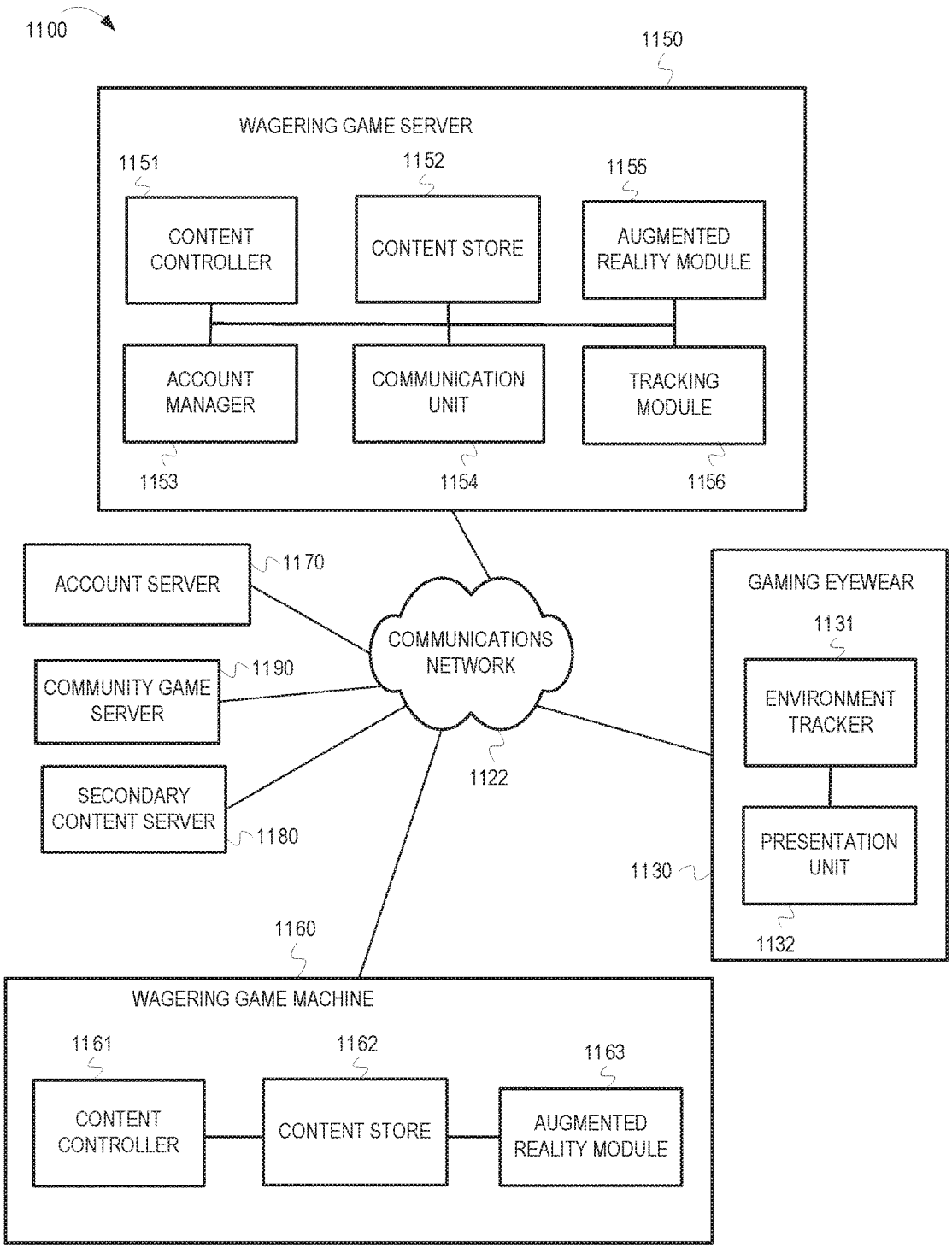
FIG. 11 is an illustration of a wagering game system architecture 1100, according to some embodiments.

FIG. 11 is a conceptual diagram that illustrates an example of a wagering game system architecture 1100, according to some embodiments. The wagering game system architecture 1100 can include an account server 1170 configured to control user related accounts accessible via wagering game networks and social networks. The account server 1170 can store wagering game player account information, such as account settings (e.g., settings related to gaming eyewear, settings related to group games, settings related to social contacts, etc.), preferences (e.g., player preferences regarding presentation of content via gaming eyewear, player preferences regarding preferred secondary content, etc.), player profile data (e.g., name, avatar, screen name, etc.), and other information for a player's account (e.g., financial information, account identification numbers, virtual assets, social contact information, etc.). The account server 1170 can contain lists of social contacts referenced by a player account. The account server 1170 can also provide auditing capabilities, according to regulatory rules. The account server 1170 can also track performance of players, machines, and servers.

The wagering game system architecture 1100 can also include a wagering game server 1150 configured to control wagering game content, provide random numbers, and communicate wagering game information, account information, and other information to and from gaming devices configured to use and/or present the content, such as a wagering game machine 1160 and/or gaming eyewear 1130. The wagering game server 1150 can include a content controller 1151 configured to manage and control content for the presentation of content on the gaming devices. For example, the content controller 1151 can generate game results (e.g., win/loss values), including win amounts, for games played via the gaming devices. The content controller 1151 can communicate the game results to the gaming devices. The content controller 1151 can also generate random numbers and provide them to the gaming devices so that the gaming devices can generate game results. The wagering game server 1150 can also include a content store 1152 configured to contain content to present on the gaming devices. The wagering game server 1150 can also include an account manager 1153 configured to control information related to player accounts. For example, the account manager 1153 can communicate wager amounts, game results amounts (e.g., win amounts), bonus game amounts, etc., to the account server 1170. The wagering game server 1150 can also include a communication unit 1154 configured to communicate information to the gaming devices and to communicate with other systems, devices and networks.

The wagering game server 1150 can also include a augmented reality module 1155 configured to generate, modify, and/or control gaming content for wagering games that use the gaming eyewear 1130. In some embodiments, the augmented reality module 1155 is configured to generate virtual content and provide the virtual content to the gaming eyewear 1130 to present as virtual images. In some embodiments, the augmented reality module 1155 is configured to detect characteristics of content, or objects, that are visible via a field of view of the gaming eyewear 1130 (e.g., which is captured by cameras of the gaming eyewear 1130 and which is communicated to the wagering game server 1150). Based on the characteristics of the content, the augmented reality module 1155 is configured to select specific content to present and provide instructions regarding where the virtual content should be presented via a field of view of the gaming eyewear 1130 (e.g., instructions regarding coordinates on a coordinate grid of where to present the virtual content). In some embodiments, the augmented reality module 1155 is incorporated into, or used in conjunction with, the content controller 1151. Further, the wagering game server 1150 includes a tracking module 1156 configured to track a position and/or orientation of the gaming eyewear 1130.

The wagering game system architecture 1100 can also include the gaming eyewear 1130 configured to present virtual content. In some embodiments, the gaming eyewear 1130 is configured to present the virtual content while real-world objects are visible within a field of view of the gaming eyewear 1130. The gaming eyewear 1130 can include an environment tracker 1141 configured to determine a location and orientation of objects presented within a gaming environment relative to the gaming eyewear 1130. For example, the environment tracker 1141 can determine a location and orientation of playing cards presented via a gaming table, a location and orientation of player stations presented on the gaming table, a location and orientation of a wagering game machine, a location and orientation of slot reels on a wagering game machine, or any other object related to the wagering game. The gaming eyewear 1130 can also include a presentation unit 1142 configured to present virtual images via the gaming eyewear 1130.

The wagering game system architecture 1100 can also include the wagering game machine 1160 configured to present wagering games and other information. The wagering game machine 1160 can include a content controller 1161 configured to manage and control content and presentation of content on the wagering game machine 1160 (e.g., present content for a card game such as Poker, Blackjack, etc.). The wagering game machine 1160 can also include a content store 1162 configured to contain content to present on the wagering game machine 1160. The wagering game machine 1160 can further include an augmented reality module 1163 configured to provide content to the gaming eyewear 1130 to present for a wagering game.

The wagering game system architecture 1100 can also include a community game server 1190 configured to provide and control content for community games, including networked games, social games, competitive games, or any other game that multiple players can participate in at the same time.

The wagering game system architecture 1100 can also include a secondary content server 1180 configured to provide content and control information for secondary games, or other secondary content, available on a wagering game network (e.g., secondary wagering game content, promotions content, advertising content, player tracking content, web content, etc.). The secondary content server 1180 can provide "secondary" content to the gaming eyewear 1130. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa.

Each component shown in the wagering game system architecture 1100 is shown as a separate and distinct element connected via a communications network 1122. However, some functions performed by one component could be performed by other components. Furthermore, the components shown may all be contained in one device, but some, or all, may be included in, or performed by, multiple devices, as in the configurations shown in FIG. 11 or other configurations not shown. For example, the account manager 1153 and the communication unit 1154 can be included in the wagering game machine 1160 instead of, or in addition to, being a part of the wagering game server 1150. Further, in some embodiments, the wagering game machine 1160 can determine wagering game outcomes, generate random numbers, etc. instead of, or in addition to, the wagering game server 1150.

In yet other embodiments, the gaming eyewear 1130 can interface with a mobile device. For instance, the gaming eyewear 1130 can connect to a smartphone, a tablet computer, a mobile wagering game machine, etc. An application on the mobile device can provide a user interface by which a player can select specific content to present via the gaming eyewear 1130 and/or select specific modes for the gaming eyewear 1130. In some embodiments, the mobile device provides functionality, services and resources that the gaming eyewear 1130 uses, such as global positioning system (GPS) services, contact and scheduling applications, processing and memory storage, etc.

The wagering game machines described herein (e.g., wagering game machine 1160) can take any suitable form, such as floor standing models, handheld mobile units, bartop models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 1100 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

Figure 12:
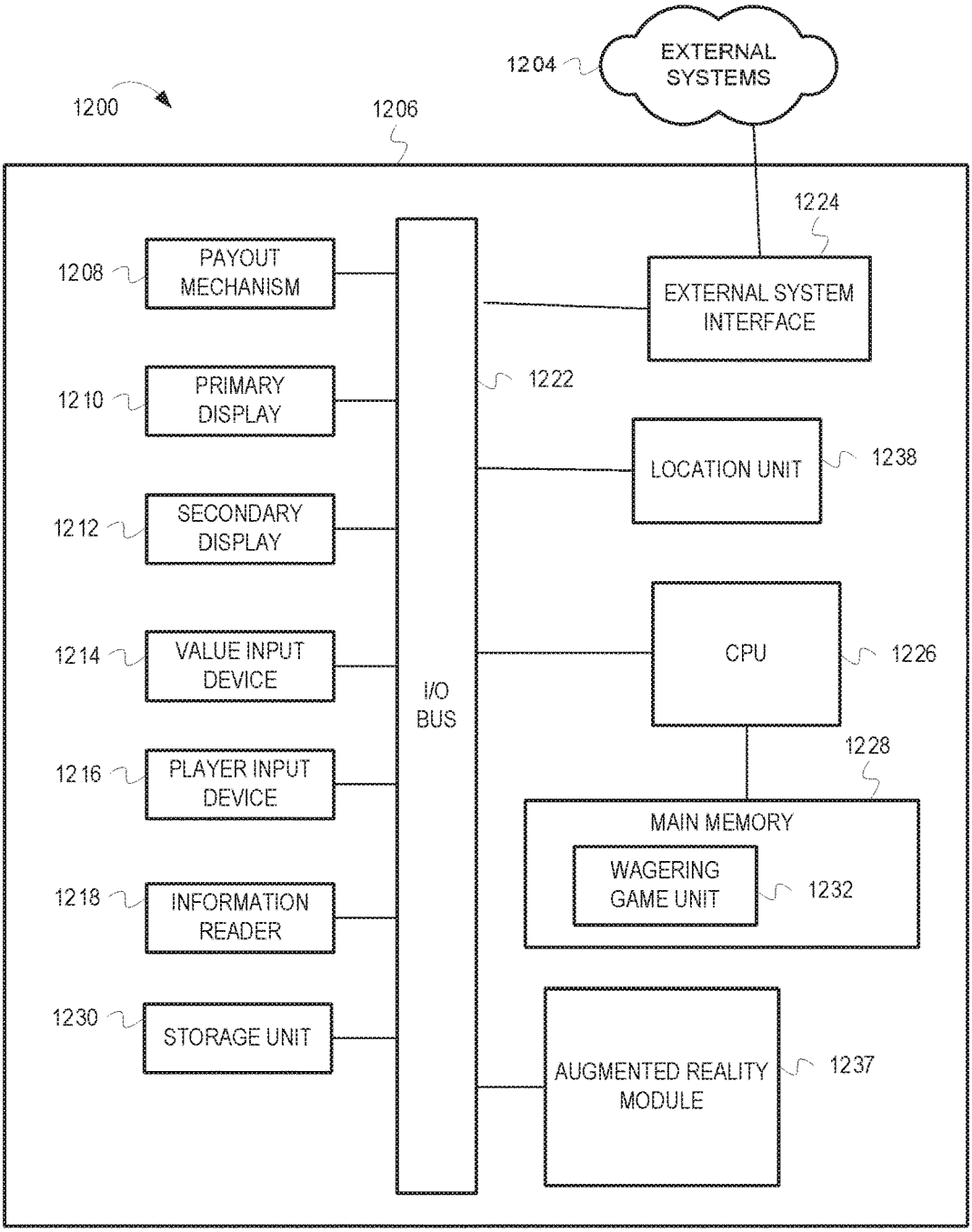
FIG. 12 is an illustration of a wagering game machine architecture 1200, according to some embodiments.

FIG. 12 is a conceptual diagram that illustrates an example of a wagering game machine architecture 1200, according to some embodiments. In FIG. 12, the wagering game machine architecture 1200 includes a wagering game machine 1206, which includes a central processing unit (CPU) 1226 connected to main memory 1228. The CPU 1226 can include any suitable processor, such as an Intel® Pentium processor, Intel® Core 2 Duo processor, AMD Opteron™ processor, or UltraSPARC processor. The main memory 1228 includes a wagering game unit 1232. In some embodiments, the wagering game unit 1232 can present wagering games, such as video poker, video black jack, video slots, video lottery, reel slots, etc., in whole or part.

The CPU 1226 is also connected to an input/output ("I/O") bus 1222, which can include any suitable bus technologies, such as an AGTL+ frontside bus and a PCI backside bus. The I/O bus 1222 is connected to a payout mechanism 1208, primary display 1210, secondary display 1212, value input device 1214, player input device 1216, information reader 1218, and storage unit 1230. The player input device 1216 can include the value input device 1214 to the extent the player input device 1216 is used to place wagers. The I/O bus 1222 is also connected to an external system interface 1224, which is connected to external systems 1204 (e.g., wagering game networks). The external system interface 1224 can include logic for exchanging information over wired and wireless networks (e.g., 802.11g transceiver, Bluetooth transceiver, Ethernet transceiver, etc.)

The I/O bus 1222 is also connected to a location unit 1238. The location unit 1238 can create player information that indicates the wagering game machine's location/movements in a casino. In some embodiments, the location unit 1238 includes a global positioning system (GPS) receiver that can determine the wagering game machine's location using GPS satellites. In other embodiments, the location unit 1238 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 12, in some embodiments, the location unit 1238 is not connected to the I/O bus 1222.

In some embodiments, the wagering game machine 1206 can include additional peripheral devices and/or more than one of each component shown in FIG. 12. For example, in some embodiments, the wagering game machine 1206 can include multiple external system interfaces 1224 and/or multiple CPUs 1226. In some embodiments, any of the components can be integrated or subdivided.

In some embodiments, the wagering game machine 1206 includes an augmented reality module 1237. The augmented reality module 1237 can process communications, commands, or other information, where the processing can present augmented reality content via gaming eyewear.

In some embodiments, the augmented reality module 1237 includes a graphics engine that can composite and present virtual content (e.g., stereoscopic 3D graphics and 2D graphics) with the appearance of objects viewable through gaming eyewear. The graphics engine can operate in concert with a video adapter and graphics buffer. The augmented reality module 1237, therefore, can cause the gaming eyewear to function as a stereoscopic 3D display device that presents the virtual content as 3D images. For instance, the gaming eyewear can present two anaglyph images via gaming eyewear. Other embodiments may utilize polarized projections, autostereoscopic presentation, computer-generated holography, volumetric display techniques, infrared laser projections, side-by-side viewing, autostereograms, pulfrich effects, prismatic & self-masking crossview techniques, lenticular prints, displays with filter arrays, wiggle stereoscopy, active 3D viewing technology (e.g., liquid crystal shutter glasses, red eye shutterglasses, virtual reality headsets, personal media viewers, etc.), passive 3D viewers (e.g., linearly polarized glasses, circularly polarized glasses, interference filter technology glasses, complementary color anaglyphs, compensating diopter glasses for red-cyan method, ColorCode 3D, ChromaDepth method and glasses, Anachrome "compatible" color anaglyph method, etc.), etc.

Furthermore, any component of the wagering game machine 1206 can include hardware, firmware, and/or machine-readable storage media including instructions for performing the operations described herein.

Wagering Game System

Figure 13:
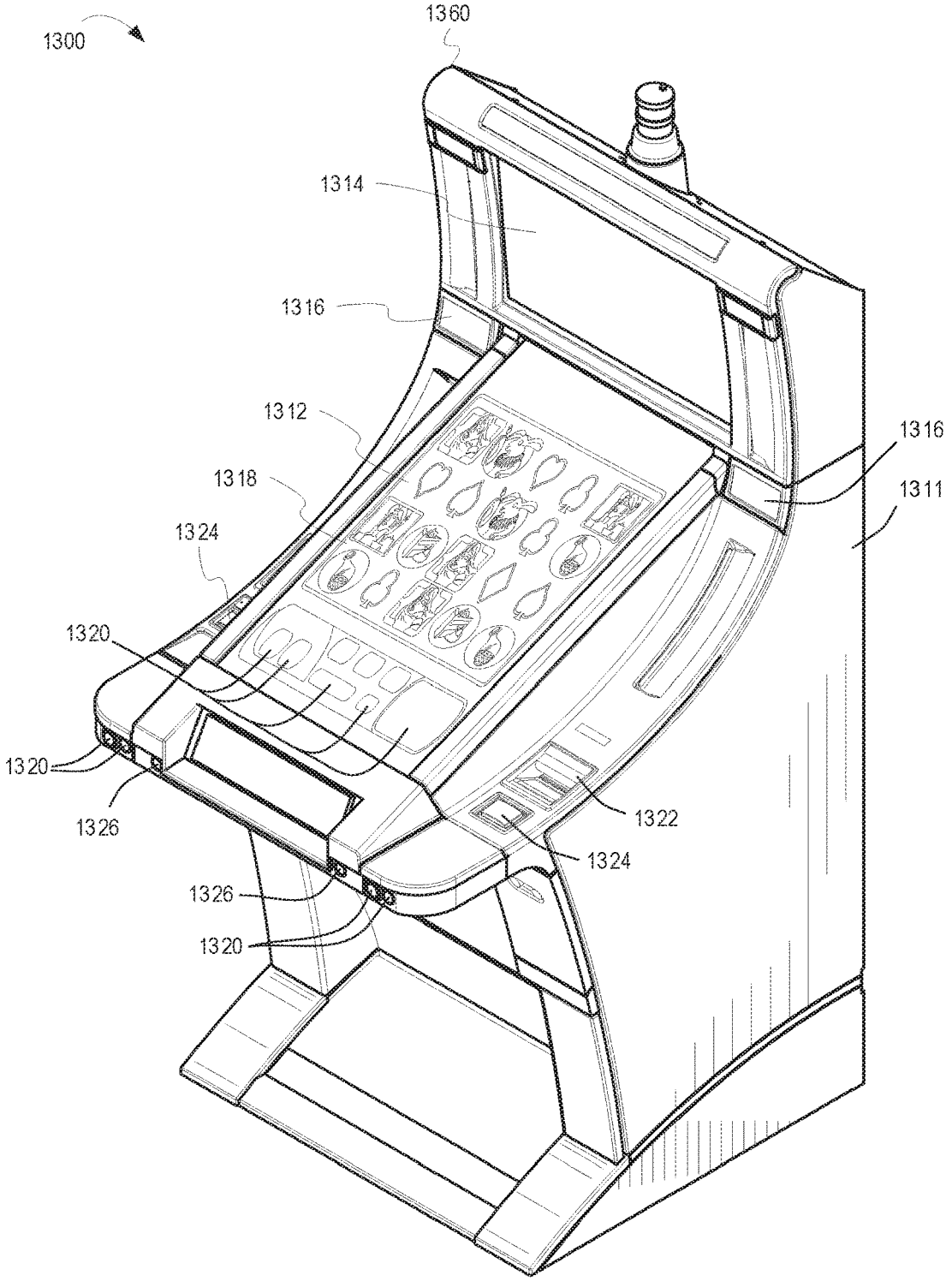
FIG. 13 is an illustration of a wagering game system 1300, according to some embodiments.

FIG. 13 is a conceptual diagram that illustrates an example of a wagering game system 1300, according to some embodiments. In FIG. 13, the wagering game system 1300 includes a wagering game machine 1360 similar to those used in gaming establishments, such as casinos. The wagering game machine 1360 may, in some examples, be referred to as a gaming terminal or an electronic gaming machine. The wagering game machine 1360 may have varying structures and methods of operation. For example, the wagering game machine 1360 may include electromechanical components configured to play mechanical slots. In another example, the 1360 includes electronic components configured to play a video casino game, such as slots, keno, poker, blackjack, roulette, craps, etc. The wagering game machine 1360 is depicted as a floor-standing model. However, other examples of wagering game machines include handheld mobile units, bartop models, workstation-type console models, etc. Further, the wagering game machine 1360 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 1360 illustrated in FIG. 13 comprises a cabinet 1311 that may house various input devices, output devices, and input/output devices. By way of example, the wagering game machine 1360 includes a primary display area 1312, a secondary display area 1314, and one or more audio speakers 1316. The primary display area 1312 or the secondary display area 1314 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 1312 or the secondary display area 1314 includes mechanical reels to display a wagering game outcome. In some example, the primary display area 1312 or the secondary display area 1314 present a transmissive video display disposed in front of a mechanical-reel display to portray a video image superimposed upon the mechanical-reel display. In FIG. 13, the wagering game machine 1360 is a "slant-top" version in which the primary display 1312 is slanted (e.g., at about a thirty-degree angle toward the player of the wagering game machine 1360). Another example of wagering game machine 1360 is an "upright" version in which the primary display 1314 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 1360. The wagering game machine 1360 includes a touch screen(s) 1318 mounted over the primary or secondary areas, buttons 1320 on a button panel, bill validator 1322, information reader/writer(s) 1324, and player-accessible port(s) 1326 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 1318, buttons 1320, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form (e.g., software, processing application) readable by a machine (e.g., a computer). For example, machine-readable storage media includes magnetic storage medium (e.g., floppy diskette), read only memory (ROM), random access memory (RAM), magnetic disk storage media, optical storage media (e.g., CD-ROM), magneto-optical storage media, flash memory, erasable programmable memory (e.g., EPROM and EEPROM), or other types of media suitable for storing electronic instructions. In addition, embodiments may be embodied in a machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating gaming eyewear, said method comprising:

detecting, via the gaming eyewear, presentation of first wagering game content via a display device associated with a wagering game machine, wherein the first wagering game content originates from a first casino wagering game;

receiving, via a communication interface unit of the gaming eyewear, second wagering game content associated with a second casino wagering game independent from the first casino wagering game;

providing the second wagering game content for presentation as a virtual image on a display of the gaming eyewear concurrent with presentation of the first wagering game content via the display device associated with the wagering game machine, wherein the display of the gaming eyewear is separate from the display device associated with the wagering game machine;

electronically connecting, via the communication interface unit, the second casino wagering game to a gaming account associated with the first casino wagering game, wherein the gaming account provides funds for use in the second casino wagering game;

detecting a virtual interaction with the second wagering game content via the gaming eyewear; and causing, in response to detecting the virtual interaction with the second wagering game content, the second casino wagering game to use at least a portion of the funds from the gaming account for one or more wagers in the second casino wagering game and to initiate game play in the second casino wagering game;

wherein the first wagering game content includes a first set of symbols from a first pay table for the first casino wagering game, wherein the second wagering game content includes a second set of symbols from a second pay table for the second casino wagering game different from the first pay table, wherein the first set of symbols are different symbols than those in the second set of symbols, wherein the first set of symbols are applicable to a group of players, and wherein the second set of symbols are unique to a specific one of the group of players associated with the gaming eyewear, and at least one of the first set of symbols and at least one of the second set of symbols are used to determine a unique game outcome for the one of the group of players.

2. The method of claim 1 further comprising:

detecting a physical gesture visible within a field of view of the gaming eyewear at a location in the field of view that corresponds to a presentation of the virtual image via the display of the gaming eyewear; and causing a game play action for one or more of the first casino wagering game or the second casino wagering game in response to detection of the physical gesture.

3. The method of claim 1, wherein the providing the second wagering game content for presentation as the virtual image on the display of the gaming eyewear comprises transmitting the second wagering game content wirelessly from a wagering game machine to a receiver of the gaming eyewear.

4. The method of claim 1 further comprising detecting, via the communication interface unit, that the first wagering game content is associated with the gaming account, and wherein the electronically connecting the second casino wagering game to the gaming account is in response to detecting that the first wagering game content is associated with the gaming account.

5. The method of claim 1 further comprising:

determining an identity of a user associated with the gaming eyewear;

determining that the first wagering game content is associated with the identity of the user; and wherein the electronically connecting the gaming eyewear to the gaming account is in response to the determining that the first wagering game content is associated with the identity of the user.

6. The method of claim 5, wherein the determining the identity of the user associated with the gaming eyewear comprising scanning a retina of the user via one or more sensors of the gaming eyewear.

7. The method of claim 1 further comprising:

detecting a first game event from the first casino wagering game, wherein the first game event comprises one or more of a first winning event and a first wager; and changing a credit meter presented on the display device of the gaming eyewear in response to the first game event.

8. The method of claim 7 further comprising:

detecting a second game event from the second casino wagering game, wherein the second game event comprises one or more of a second winning event and a second wager; and changing the credit meter presented on the display device of the gaming eyewear in response to the second game event.

9. The method of claim 1 further comprising:

detecting a coded identifier visible via the display of the gaming eyewear; and presenting the second casino wagering game via the display of the gaming eyewear at a location of the coded identifier to indicate a game play element used for a game outcome of the second casino wagering game.

10. One or more non-transitory machine-readable storage media having instructions stored thereon, the instructions, when executed by a set of one or more processors of a gaming system cause the set of one or more processors to perform operations for controlling the gaming system, the instructions comprising:

instructions to detect a unique characteristic of an individual via electronic gaming eyewear;

instructions to automatically connect, via a network communication interface of the gaming system, the electronic gaming eyewear to a player account associated with the individual in response to detecting the unique characteristic;

instructions to detect, via the electronic gaming eyewear, first wagering game content presented via a display device associated with a wagering game machine, wherein the first wagering game content originates from a first casino wagering game;

instructions to provide second wagering game content for presentation via a display of the electronic gaming eyewear, wherein the second wagering game content originates from a second casino wagering game independent from the first casino wagering game;

instructions to electronically connect, via the network communication interface, the second casino wagering game to the player account, wherein the player account provides funds for use in a second casino wagering game;

instructions to access, via the network communication interface, one or more first statistics associated with the player account regarding wagering game play associated with one or more of the first wagering game content or the second wagering game content;

instructions to provide the one or more first statistics for presentation via the display of the electronic gaming eyewear;

instructions to determine one or more second statistics associated with one or more of wagering game machine and one or more additional player accounts associated with the one or more of the first wagering game content or the second wagering game content;

instructions to provide, for presentation via the display of the electronic gaming eyewear, the one or more second statistics;

instructions to detect a virtual interaction with the second wagering game content via the electronic gaming eyewear;

instructions to cause, in response to detecting the virtual interaction with the second wagering game content, the second casino wagering game to use at least a portion of the funds from the player account for one or more wagers in the second casino wagering game and to initiate game play in the second casino wagering game, wherein the first wagering game content includes a first set of symbols from a first pay table for the first casino wagering game, wherein the second wagering game content includes a second set of symbols from a second pay table for the second casino wagering game different from the first pay table, wherein the first set of symbols are different symbols than those in the second set of symbols, wherein the first set of symbols are applicable to a group of players, and wherein the second set of symbols are unique to a specific one of the group of players associated with the electronic gaming eyewear; and instructions to use at least one of the first set of symbols and at least one of the second set of symbols to determine a unique game outcome for the one of the group of players.

11. The one or more non-transitory, machine-readable storage media of claim 10, said instructions further comprising:

instructions to query, via the network communication interface, a database with a description of the unique characteristic;

instructions to, based on the querying of the database, determine an identity of a player associated with the player account; and instructions to access the player account based on the identity of the player.

12. A gaming system comprising:

at least one electronic processing unit;

a network communication interface; and at least one memory device configured to store instructions which, when executed by the at least one electronic processing unit, control the gaming system, the instructions including instructions to:

detect a unique characteristic of an individual via electronic gaming eyewear, automatically connect, via the network communication interface, the electronic gaming eyewear to a player account associated with the individual in response to detecting the unique characteristic of the individual, detect, via the electronic gaming eyewear, first wagering game content presented via a display device associated with the gaming system, wherein the first wagering game content originates from a first casino wagering game, provide second wagering game content for presentation via a display of the electronic gaming eyewear, wherein the second wagering game content originates from a second casino wagering game independent from the first casino wagering game, electronically connect, via the network communication interface, the second casino wagering game to the player account, wherein the player account provides funds for use in a second casino wagering game, access, via the network communication interface, one or more statistics associated with the player account regarding wagering game play associated with one or more of the first wagering game content or the second wagering game content, provide the one or more statistics for presentation via the display of the electronic gaming eyewear, detect a virtual interaction with the second wagering game content via the electronic gaming eyewear, in response to detection of the virtual interaction with the second wagering game content, cause the second casino wagering game to use at least a portion of the funds from the player account for one or more wagers in the second casino wagering game and to initiate game play in the second casino wagering game, wherein the first wagering game content includes a first set of symbols associated with first game rules for the first casino wagering game, wherein the second wagering game content includes a second set of symbols from second game rules for the second casino wagering game different from the first game rules, wherein the first set of symbols are different symbols than those in the second set of symbols, wherein the first set of symbols are applicable to a group of players, and wherein the second set of symbols are unique to a specific one of the group of players associated with the electronic gaming eyewear, and use at least one of the first set of symbols and at least one of the second set of symbols to determine a unique game outcome for the one of the group of players.

13. The gaming system of claim 12, the instructions further including instructions to:

query, via the network communication interface, an account server with an indication of the unique characteristic to determine an identity of a player associated with the player account; and access the player account based on the identity of the player.

14. The gaming system of claim 12, the instructions further including instructions to cause the gaming system to access the one or more statistics from the player account.

15. The gaming system of claim 12, the instructions further including:

instructions to determine one or more additional statistics associated with one or more of a wagering game machine and one or more additional player accounts associated with one or more of the first wagering game content and the second wagering game content; and instructions to provide, for presentation via the display of the electronic gaming eyewear, the one or more additional statistics.

16. A gaming system comprising:

at least one electronic processing unit;

a communication interface unit; and one or more memory storage devices configured to store instructions, which when executed by the at least one electronic processing unit, cause the gaming system to perform operations to control the gaming system, the instructions including:

instructions to provide first content for presentation on an electronic display device, wherein the first content is for a first casino wagering game;

instructions to establish, via the communication interface unit, a communication link with gaming eyewear;

instructions to determine that the gaming eyewear is associated with at least one participant of the first casino wagering game;

instructions to determine that the first content is visible within a field of view of the gaming eyewear;

instructions to provide second wagering game content for presentation as a virtual image on a display of the gaming eyewear concurrent with presentation of the first wagering game content via the electronic display device, wherein the second wagering game content is for a second casino wagering game independent from the first casino wagering game;

instructions to electronically connect, via the communication interface unit, the second casino wagering game to a gaming account associated with the first casino wagering game, wherein the gaming account provides funds for use in the second casino wagering game;

instructions to provide, via the communication interface unit, a virtual wagering game control for presentation as a virtual image via the display of the gaming eyewear, wherein the display of the gaming eyewear is separate from the electronic display device;

instructions to detect a physical gesture viewable within the field of view of the gaming eyewear at a location in the field of view that corresponds to a presentation of the virtual image via the display of the gaming eyewear;

instructions to cause a game play action for one or more of the first casino wagering game or the second casino wagering game in response to detection of the physical gesture, wherein the first wagering game content includes a first set of symbols from a first pay table for the first casino wagering game, wherein the second wagering game content includes a second set of symbols from a second pay table for the second casino wagering game different from the first pay table, wherein the first set of symbols are different symbols than those in the second set of symbols, wherein the first set of symbols are applicable to a group of players, wherein the second set of symbols are unique to a specific one of the group of players associated with the gaming eyewear; and instructions to use at least one of the first set of symbols and at least one of the second set of symbols to determine a unique game outcome for the one of the group of players.

17. The gaming system of claim 16, wherein the instructions further include:

instructions to detect that a finger is placed in the field of view at the location that coincides with presentation of the virtual image; and instructions to detect that the finger performs a particular action that indicates selection of the virtual wagering game control.

18. The gaming system of claim 16, wherein the instructions further include:

instructions to map a first body part visible within the field of view to the virtual wagering game control; and instructions to map a second body part to the first body part, and wherein the instructions configured to cause the gaming system to perform operations to detect the physical gesture include instructions, which when executed by the at least one electronic processing unit, cause the gaming system to detect, via electronic analysis of the field of view, that the first body part touches the second body part.

19. The gaming system of claim 16, wherein the instructions to detect the physical gesture include instructions to detect, via electronic analysis of the field of view, that two or more body parts perform a gesturing combination.

20. The gaming system of claim 16, wherein the instructions include instructions to cause the gaming system to access, via the communication interface unit from a memory storage unit associated with the at least one participant, an indication of a meaning of the physical gesture to perform the game play action, and wherein the instructions configured to cause the gaming system to cause the game play action include instructions to:

evaluate an appearance of the physical gesture against the indication of the meaning of the physical gesture;

determine that the appearance of the physical gesture corresponds to the game play action based on evaluation of the appearance of the physical gesture against the indication of the meaning; and perform the game play action in response to determination that the appearance of the physical gesture corresponds to the game play action.

21. A gaming apparatus comprising:

means for presenting a virtual image of a game function control of a first casino wagering game via a display of gaming eyewear;

means for detecting a physical gesture visible within a field of view of the gaming eyewear at a first location in the field of view of the gaming eyewear that corresponds to a presentation of the virtual image via the display of the gaming eyewear;

means for determining that a second location of the physical gesture visible within the field of view corresponds to the first location that corresponds to the presentation of the virtual image;

means for accessing a setting of a player account associated with the gaming eyewear, wherein the setting indicates a meaning of the physical gesture to perform a specific wagering game function;

means for evaluating an appearance of the physical gesture against the meaning of the physical gesture indicated in the setting;

means for determining, based on evaluation of the appearance of the physical gesture against the meaning of the physical gesture in the setting, that the physical gesture indicates to perform the specific wagering game function;

means for performing the specific wagering game function based on determining that the physical gesture indicates to perform the specific wagering game function, wherein the first casino wagering game includes a first set of symbols associated with one or more of first game rules or a first pay table;

means for presenting, via the gaming eyewear, a second casino wagering game independent from the first casino wagering game, wherein the second casino wagering game includes a second set of symbols associated with one or more of second game rules or a second pay table different from that of the first casino wagering game, wherein the first set of symbols are different symbols than those in the second set of symbols, wherein the first set of symbols are applicable to a group of players, wherein the second set of symbols are unique to a specific one of the group of players associated with the gaming eyewear; and means for using use at least one of the first set of symbols and at least one of the second set of symbols to determine a unique game outcome for the one of the group of players.

22. The gaming apparatus of claim 21, further comprising means for presenting the virtual image of the game function control as superimposed over a body part of a player that is viewable via the field of view of the gaming eyewear.

23. The gaming apparatus of claim 22, wherein the means for determining that the first location of the physical gesture corresponds to the second location that corresponds to the presentation of the virtual image comprises means for detecting a physical interaction with the body part of the player on which the virtual image of the game function control is superimposed.

24. The gaming apparatus of claim 21, wherein the means for performing the specific wagering game function comprises means for conducting a wager for the casino wagering game.

* * * * *